US007839372B2

(12) United States Patent
Ishii et al.

(10) Patent No.: US 7,839,372 B2
(45) Date of Patent: Nov. 23, 2010

(54) ELECTROOPTIC APPARATUS SUBSTRATE AND EXAMINING METHOD THEREFOR AND ELECTROOPTIC APPARATUS AND ELECTRONIC EQUIPMENT

(75) Inventors: Tatsuya Ishii, Fujimi-cho (JP); Shigefumi Yamaji, Chitose (JP); Koichi Mizugaki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 976 days.

(21) Appl. No.: 11/572,443

(22) PCT Filed: Aug. 8, 2005

(86) PCT No.: PCT/JP2005/014869

§ 371 (c)(1),
(2), (4) Date: Jan. 22, 2007

(87) PCT Pub. No.: WO2006/016686

PCT Pub. Date: Feb. 16, 2006

(65) Prior Publication Data

US 2009/0267873 A1 Oct. 29, 2009

(30) Foreign Application Priority Data

Aug. 10, 2004 (JP) ..... 2004-233065
Oct. 20, 2004 (JP) ..... 2004-305212
May 6, 2005 (JP) ..... 2005-134987

(51) Int. Cl.
*G09G 3/36* (2006.01)

(52) U.S. Cl. ..... 345/98; 345/208; 345/211; 345/214

(58) Field of Classification Search ..... 345/76–78, 345/82–84, 98–100, 211–214, 204, 690, 345/904; 324/537
See application file for complete search history.

(56) References Cited

U.S. PATENT DOCUMENTS 5,021,774 A 6/1991 Ohwada et al.
5,377,030 A 12/1994 Suzuki et al.
5,424,990 A 6/1995 Ohsawa
5,539,326 A 7/1996 Takahashi et al.
5,812,476 A 9/1998 Segawa
6,498,755 B2 * 12/2002 Takahashi et al. ..... 365/189.14
6,901,026 B2 * 5/2005 Takeuchi et al. ..... 365/233.5
7,006,067 B2 2/2006 Tobita et al.

(Continued)

FOREIGN PATENT DOCUMENTS

EP 0 615 253 A2 9/1994

(Continued)

*Primary Examiner*—Henry N Tran
(74) *Attorney, Agent, or Firm*—Oliff & Berridge, PLC

(57) ABSTRACT

An electrooptic apparatus substrate and examination method therefor can be provided which can implement an examination without requiring bringing a probe into contact thereto from the outside and with satisfactory measuring accuracy. A substrate 1 of the present invention includes a video line 7 and transmission date portion 6 through multiple switching elements for writing a first potential signal in multiple pixels through a signal line. The substrate 1 further includes a display data reading circuit portion 4 having a differential amplifier 4*a* for lowering a lower potential and heightening a higher potential and outputting it to the signal line and a transmission gate portion 6 and video line 7 for reading the first potential signal and a reference second potential signal.

24 Claims, 16 Drawing Sheets

U.S. PATENT DOCUMENTS

| | | | | |
|---|---|---|---|---|
| 2004/0252116 | A1* | 12/2004 | Tobita | 345/211 |
| 2006/0119563 | A1* | 6/2006 | Nakamura et al. | 345/98 |

FOREIGN PATENT DOCUMENTS

| | | |
|---|---|---|
| JP | A-2-154292 | 6/1990 |
| JP | A 5-341302 | 12/1993 |
| JP | A 7-333278 | 12/1995 |
| JP | A-10-50058 | 2/1998 |
| JP | A 10-104563 | 4/1998 |
| JP | A-2000-47255 | 2/2000 |
| JP | A-2000-304796 | 11/2000 |
| JP | A-2002-351430 | 12/2002 |
| JP | A-2003-114658 | 4/2003 |
| JP | A 2004-226551 | 8/2004 |
| JP | A 2005-024558 | 1/2005 |
| KR | 96-008100 | 6/1996 |

* cited by examiner

FIG. 6

(a)

| | 6 | 5 | 4 | 3 | 2 | 1 |
|---|---|---|---|---|---|---|
| 1 | L | H | L | H | L | H |
| 2 | L | H | L | H | L | H |
| 3 | L | H | L | H | L | H |
| 4 | L | H | L | H | L | H |

(b)

| | 6 | 5 | 4 | 3 | 2 | 1 |
|---|---|---|---|---|---|---|
| 1 | H | L | H | L | H | L |
| 2 | H | L | H | L | H | L |
| 3 | H | L | H | L | H | L |
| 4 | H | L | H | L | H | L |

| | 6 | 5 | 4 | 3 | 2 | 1 |
|---|---|---|---|---|---|---|
| 1 | M | H | M | H | M | H |
| 2 | M | H | M | H | M | H |
| 3 | M | H | M | H | M | H |
| 4 | M | H | M | H | M | H |

ELECTROOPTIC APPARATUS SUBSTRATE AND EXAMINING METHOD THEREFOR AND ELECTROOPTIC APPARATUS AND ELECTRONIC EQUIPMENT

TECHNICAL FIELD

The present Invention relates to an electrooptic apparatus substrate and examining method therefor and an electrooptic apparatus and an electronic apparatus. In particular, the present invention relates to an electrooptic apparatus substrate and examining method therefor and electrooptic apparatus and electronic apparatus in which multiple switching devices are provided in multiple pixels.

BACKGROUND ART

A display device such as a liquid crystal device has been conventionally and widely used in apparatus such as a cellular phone and a projector. A liquid crystal display device having a TFT (Thin Film Transistor) includes a TFT substrate and a facing substrate, which are pasted to each other, and has liquid crystal sealed between the substrates. In general, the examination for checking whether a manufactured liquid crystal device is performed on the finished product. For example, a predetermined image signal may be input to, projected to and displayed on the liquid crystal device as display data so that whether the data can be displayed correctly and the presence of any lacking pixel can be checked.

However, the method of examining a finished product is not preferable from the viewpoint of management of manufacturing steps. This is because the detection of a poor product is delayed since the poor product is detected after the steps of manufacturing the substrate.

This increases the time taken for feeding back the detection of a poor product to the step management. As a result, the period with a low yield increases, which also increases the manufacturing cost. Also in prototyping, in since the period from the evaluation of a prototype to the feedback to the design process increases, which may increase the development period and the development costs. Furthermore, the repair of a poor point is difficult after the product is finished.

Accordingly, a poor point, especially, a lacking pixel in a display device is desirably detected within steps of manufacturing the substrate.

One of such examining methods proposed is a technology for examining a liquid crystal display device by bringing an examination probe in contact with an electrode pad of a liquid crystal display device and supplying a predetermined amount of current thereto (see Patent Document 1, for example). Furthermore, another technology is proposed for applying a predetermined amount of voltage to each pixel on a TFT substrate in consideration of the capacitor characteristic of pixels and examining the function of the TFT based on waveforms of the discharged current and discharged voltage (see Patent Document 2, for example).

Furthermore, another technology is proposed for examining an operation of each pixel electrode by detecting an amount of potential change of a pixel electrode on the TFT substrate by using an opposed electrode for examination corresponding to the pixel electrode (see Patent Document 3, for example).

[Patent Document 1]: Japanese Unexamined Patent Application Publication No. 5-341302;

[Patent Document 2]: Japanese Unexamined Patent Application Publication No. 7-333278; and

[Patent Document 3]; Japanese Unexamined Patent Application Publication No. 10-104563

DISCLOSURE OF INVENTION

Problem to be Solved by the Invention

However, with the technologies disclosed in Patent Documents 1 and 3, the positional accuracy is mechanically required in an examination apparatus in order to bring a predetermined probe into contact with or near an electrode pad from the outside of the substrate. As a result, a problem of long examination time occurs for achieving the mechanical alignment accuracy. Furthermore, these methods may not be applicable to a high definition liquid crystal display device since a thin probe must be brought in contact with many electrode pads under mechanical control.

The method disclosed in Patent Document 2 is influenced by capacity components between a liquid crystal display device and a measuring device such as capacities in a source line, image signal line, electrode pad terminal and so on. Therefore, a problem that satisfactory measuring accuracy cannot be obtained when the pixels have lower capacity.

The present invention was made in view of these points, and it is an object of the present invention to provide an electrooptic apparatus substrate and examination method therefor by which an examination with satisfactory measuring accuracy can be performed without contact of a probe from the outside.

Means for Solving Problem

An electrooptic apparatus substrate of the present invention includes multiple scan lines and multiple signal lines intersecting each other, multiple pixels disposed in accordance with the intersections of the multiple scan lines and the multiple signal lines, and an amplifying unit electrically connected to the signal lines, to which a signal input to the pixels is input through the signal lines, for amplifying the potential of the input signal.

The amplifying unit may be electrically connected to a pair of the signal lines and amplify a potential difference between the signals supplied from each of the pairs of signal lines.

An electrooptic apparatus substrate of the present invention includes multiple scan lines and multiple signal lines intersecting each other, multiple pixels disposed in a matrix in accordance with the intersections of the multiple scan lines and the multiple signal lines, multiple switching elements each provided for each of the multiple pixels, an amplifying unit to which a first electric signal is input through a first signal line of the multiple signal lines and a second potential signal is input as a reference potential, and data reading unit for reading an output potential signal output from the amplifying unit to the multiple signal lines. In this case, the amplifying unit may compare the first potential signal and the second potential signal, and, if the first potential signal is lower, lower the potential of the signal line and output the lowered output potential signal to the signal line, and, if the first potential signal is higher, heighten the potential of the signal line and output the heightened output potential signal to the signal line.

Under this construction, an electrooptic apparatus substrate and examination method therefor can be provided which can implement an examination without requiring bringing a probe into contact thereto from the outside and with satisfactory measuring accuracy.

In the electrooptic apparatus substrate of the present invention, the first potential signal may have a potential of a signal supplied to all or a part of the multiple pixels through the multiple switching elements, and the potential of the second potential signal may be a potential supplied from a reference signal line.

Under this construction, a pixel failure can be detected as a failure in each pixel.

In the electrooptic apparatus substrate of the present invention, the first potential signal and the second potential signal may have a potential of a signal supplied to all or a part of the multiple pixels through the multiple switching elements, and the first potential signal and the second potential signal may be supplied to the respective amplifying unit through the first signal line and the second signal line of the multiple signal line, respectively.

Under this construction, if any one of two pixels has a failure, the failure can be detected since the potentials of the two pixels are compared.

In the electrooptic apparatus substrate of the present invention, the amplifying unit may be a differential amplifier.

In the electrooptic apparatus substrate of the present invention, the data reading unit may have a differential amplifier for outputting the read potential signal.

Under this construction, the difference between the potentials of two signal lines can be clarified and output.

In the electrooptic apparatus substrate of the present invention, each of the multiple pixels may have an additional capacitor.

Under this construction, a failure in the additional capacitor can be detected.

The electrooptic apparatus substrate of the present invention may further include a pre-charge circuit connected to the multiple signal lines for pre-charging the potential of the multiple signal lines to a predetermined potential.

Under this construction, the present invention is applicable to an examination on a characteristic.

The electrooptic apparatus substrate of the present invention may further include an image signal line for supplying an image signal supplied to the multiple pixels and multiple transmission gates for supplying an image signal supplied from the image signal line to the multiple signal lines, wherein the data reading unit includes the image signal line.

Under this construction, multiple transmission gates are controlled so that an image signal can be supplied to the video signal line and an image signal can be read therefrom.

The electrooptic apparatus of the present invention which an electrooptic substance is provided between a pair of substrates may include the electrooptic apparatus substrate on one of the paired substrates.

An electrooptic equipment of the present invention includes the electrooptic apparatus of the present invention.

Under this construction, an electrooptic apparatus or electrooptic equipment having an electrooptic apparatus substrate can be provided which can implement an examination without requiring bringing a probe into contact thereto from the outside and with satisfactory measuring accuracy.

An examination method for an electrooptic apparatus substrate of the present invention having multiple scan lines and multiple signal lines intersecting each other, multiple pixels disposed in a matrix for the intersections of the multiple scan lines and the multiple signal lines, and multiple switching elements each provided for each of the multiple pixels, the method including a supplying step of supplying a first potential signal to a pixel corresponding to one of the signal lines, a reading step of reading the first potential signal supplied to the pixel through the signal line, an output step of comparing a second potential signal having a different potential from that of the first potential signal and serving as a reference signal and the read first potential signal, and, if the first potential signal is lower, lowering the potential of the signal line and outputting the lowered output potential signal to the signal line, and, if the first potential signal is higher, heightening the potential of the signal line and outputting the heightened output potential signal to the signal line, and a comparing step of comparing the first potential signal supplied by the supplying step and the output potential signal output by the output step.

Under this construction, an examination method for an electrooptic apparatus can be implemented without requiring bringing a probe into contact thereto from the outside and with satisfactory measuring accuracy.

The examination method for an electrooptic apparatus substrate of the present invention may further include a pre-charging step of causing the signal line to have a predetermined pre-charge potential before the reading step.

Under this construction, a characteristic of an electrooptic apparatus substrate can be examined.

In the examination method for an electrooptic apparatus substrate of the present invention, the predetermined pre-charge potential may be a middle potential between the first potential signal and the second potential signal.

Under this construction, the written first and second potential signals can be compared with reference to the middle potential.

In the examination method for an electrooptic apparatus substrate of the present invention, each of the multiple pixels preferably has an additional capacitor.

Under this construction a failure in the additional capacitor can be detected.

In the examination method for an electrooptic apparatus substrate of the present invention, the potential of the second potential signal may be an externally supplied potential.

Under this construction, a pixel failure can be detected as a failure in each pixel.

In the examination method for an electrooptic apparatus substrate of the present invention, in the supplying step, the first and second potential signals preferably have potentials of the signals supplied to two pixels through the multiple switching elements, and, in the reading step, the first and second potential signals are preferably read through the respective two signal lines.

Under this construction, if any one of two pixels has a failure, the failure can be detected since the potentials of the two pixels are compared.

Preferably, in the examination method for an electrooptic apparatus substrate of the present invention, in the supplying step, one of the two pixels is handled as a pixel to be examined and a HIGH signal is supplied as the first potential signal to the pixel to be examined and the other of the two pixels is handled as a reference pixel and a LOW signal is supplied as the second potential signal to the reference pixel, and a failure in the additional capacitor is determined if the potential signal read from the pixel to be examined is LOW in the comparing step.

Under this construction, a failure in a capacitor of a pixel can be determined.

In the examination method for an electrooptic apparatus substrate of the present invention, the potential of a common fixed electrode of the additional capacitor may be a potential lower than the potential in supplying the LOW signal.

Under this construction, the reading potential is changed to be lower than the reference potential so that a voltage change due to a leak failure can appear.

In the examination method for an electrooptic apparatus substrate of the present invention, the predetermined pre-charge potential may be a potential higher than the potential heightened by the output step.

Under this construction, the written first and second potential signals can be compared with reference to the higher potential.

In the examination method for an electrooptic apparatus substrate of the present invention, in the supplying step, one of the two pixels may be handled as a pixel to be examined and a LOW signal may be supplied as the first potential to the pixel to be examined and the other of the two pixels may be handled as a reference pixel and a HIGH signal may be supplied as the second potential to the reference pixel, and a failure in the switching element is determined if the potential signal read from the pixel to be examined is HIGH in the comparing step.

Under this construction, a failure in the switching element of a pixel can be determined.

In the examination method for an electrooptic apparatus substrate of the present invention, in the supplying step, one of the two pixels may be handled as a pixel to be examined and a LOW or HIGH signal may be supplied as the first potential to the pixel to be examined and the other of the two pixels may be handled as a reference pixel and a middle potential signal having the potential between the potential of the first LOW signal and the potential of the HIGH signal may be supplied as the second potential to the reference pixel, and a failure in the switching element or additional capacitor may be determined if the potential read from the pixel to be examined does not agree with the first potential in the comparing step.

Under this construction a failure in the capacitor or switching element of a pixel can be detected.

In the examination method for an electrooptic apparatus substrate of the present invention, the two signal lines are preferably adjacent to each other.

Under this construction, since the adjacent pixels are equally influenced by outside noise, a misoperation does not easily occur in the output step.

In the examination method for an electrooptic apparatus substrate of the present invention, the supplying step, the reading step, the output step and the comparing step are preferably sequentially performed on the multiple pixels.

Under this construction, all required pixels in a matrix can be examined.

INDUSTRIAL APPLICABILITY

The present invention is applicable to not only the above-described liquid crystal display device including a TFT but also an active-matrix driven display device.

BRIEF DESCRIPTION OF THE DRAWINGS

FIG. 6 includes diagrams each showing a state of pixel data written in pixels according to the first embodiment.

REFERENCE NUMERALS

Figure 1:
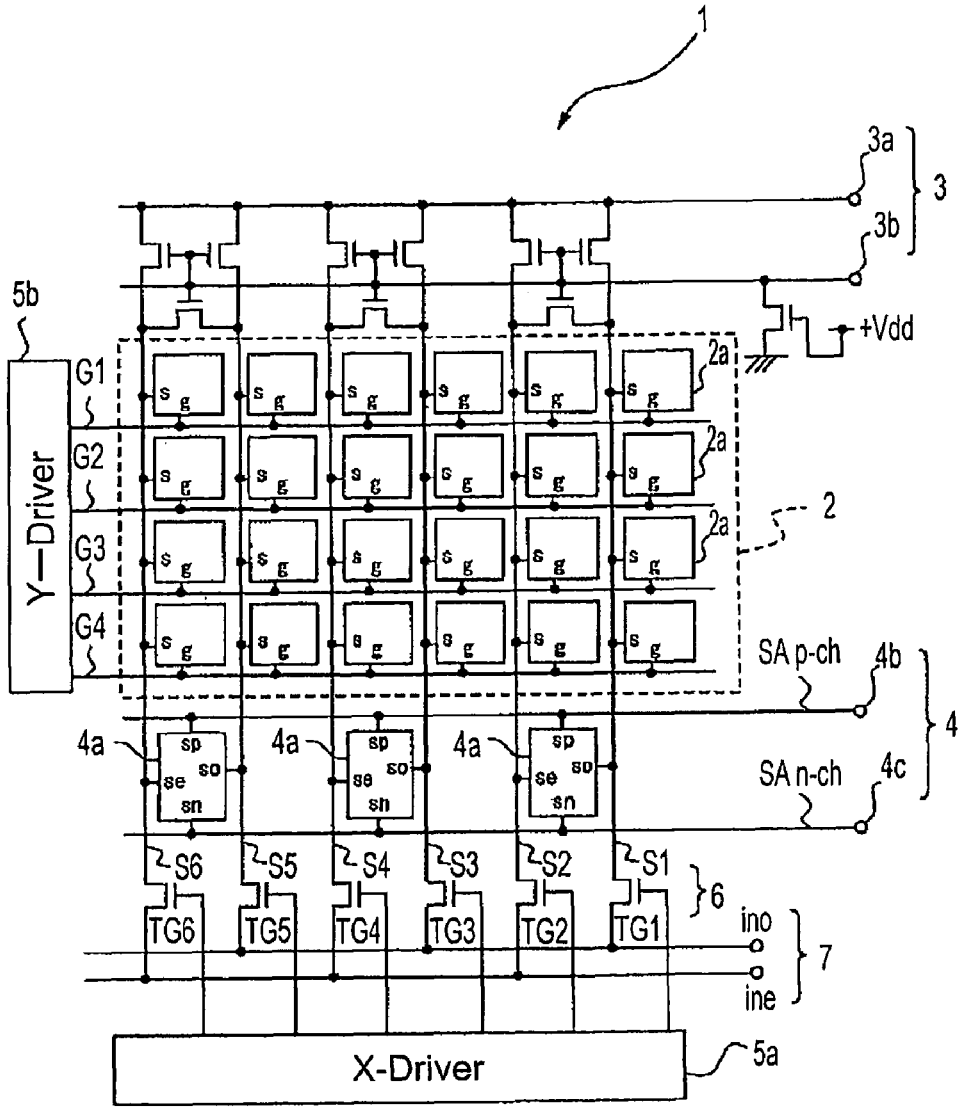
FIG. 1 is a circuit diagram of an element substrate of a liquid crystal display device according to a first embodiment.

1 and 1A element substrates
2 display element array portion
3 pre-charge circuit portion
4 display data reading circuit portion
4*a* differential amplifier
6 transmission gate portion
7 image signal line

BEST MODE FOR CARRYING OUT THE INVENTION

Embodiments of the present invention will be described below with reference to drawings.

Here, an active-matrix type display device substrate for use in a liquid crystal display device will be described as an example of an electrooptic device substrate of the present invention.

First Embodiment

First of all, FIG. 1 is a circuit diagram of an element substrate of a liquid crystal display device according to a first embodiment of the invention. The element substrate of the liquid crystal display device is an active-matrix type display device substrate. An element substrate 1 includes a display element array portion 2, a pre-charge circuit portion 3 and a display data reading circuit portion 4. The display element array portion 2 serving as a display portion includes multiple pixel cells in a two-dimensional m×n matrix. Here, m and n are both integers. An X-driver portion 5*a*, a Y-driver portion 5*b*, a transmission gate portion 6, and an image signal line 7 are further included therein in order to drive multiple pixels 2*a* aligned in the X-direction (horizontal direction) and Y-direction (vertical direction, of the display element array portion 2. The X-driver portion 5*a*, Y-driver portion 5*b*, transmission gate portion 6 and image signal line 7 serve as a data writing unit and a data reading unit.

The transmission gate portion 6 supplies a pixel data signal input from the image signal line 7 in response to an output timing signal from the X-driver portion 5*a*. The image signal line 7 has a signal line for supplying a signal to an odd-numbered column of the display element array portion 2 in a matrix form and a signal line for supplying a signal to an even-numbered column thereof and connects to the respective terminals ino and ine.

The display element array portion 2 has an matrix including the first column, second column, . . . and the nth column from the right by the first row, second row, . . . and the mth column from the top. However, for simple description, FIG. 1 shows an example of a circuit including pixels in a 4 (columns)×6 (rows) matrix.

The pre-charge circuit portion 3 is used for pre-charging each source line to a predetermined potential for the examination of a characteristic, as described later.

The display data reading circuit portion 4 has multiple differential amplifiers 4*a* each connecting to a pair of source lines including an odd-numbered column source line S(odd) and even-numbered column source line S(even) in the two-dimensional matrix. The display data reading circuit portion 4 functioning as a test circuit used for examination is provided on an element substrate of an active-matrix-driven liquid crystal display panel.

Figure 2:
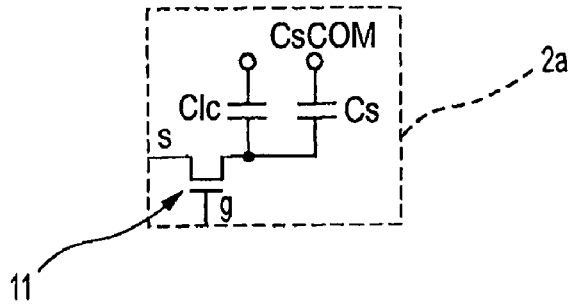
FIG. 2 is an equivalent circuit diagram of a pixel according to the first embodiment.

Next, the pixels 2*a* will be described which are unit display elements of the display element array portion 2. FIG. 2 is an equivalent circuit diagram of one pixel serving as one memory cell according to this embodiment.

Each of the pixels 2*a* includes a thin film transistor (called TFT, hereinafter) 11 functioning as a switching element, a liquid crystal capacitor Clc and an additional capacitor Cs connecting to the liquid crystal capacitor Clc in parallel. One end of each of the liquid crystal capacitor Clc and additional capacitor Cs is connected to the drain terminal of the TFT 11. The other end of the additional capacitor Cs is connected to a common fixed potential CsCOM. A transistor may function as a switching element for each pixel where the element substrate 1 contains a semiconductor substance such as monocrystal silicon or a semiconductor compound. The gate terminal g of the TFT 11 is corrected to a scan line G from the Y-driver 5*b*. When the TFT 11 is turned on in response to an input of a predetermined voltage signal to the gate terminal g of the TFT 11, the voltage being applied to the source terminal s of the TFT 11 connecting to the source line S is applied to the liquid crystal capacitor Clc and additional capacitor Cs so that the supplied predetermined potential can be maintained.

Figure 3:
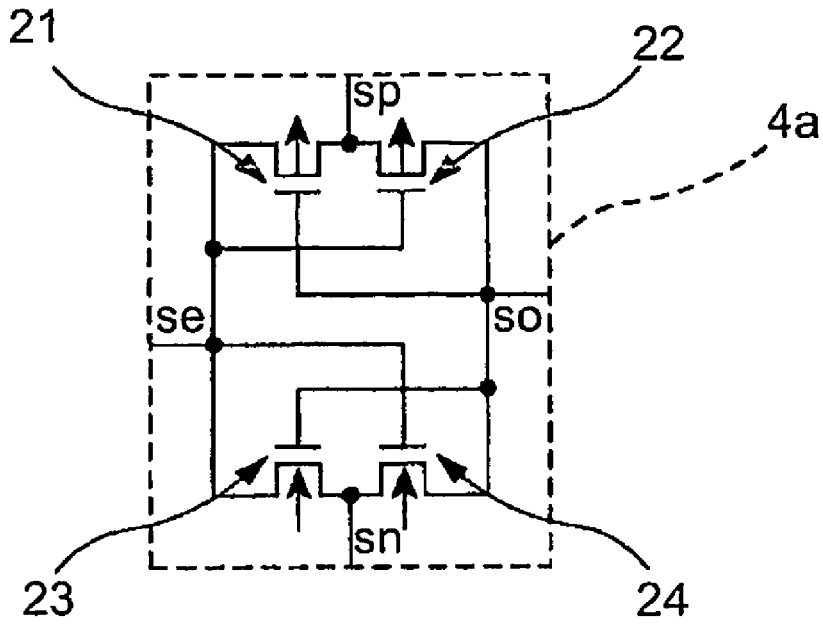
FIG. 3 is a circuit diagram of a differential amplifier according to the first embodiment.

FIG. 3 is a circuit diagram of the differential amplifier 4*a* of the display data reading circuit portion 4. In FIG. 3, (n/2) differential amplifier 4*a* is provided for n pixels (where n is an even integer) in one direction of the two-dimensional matrix, in this case, in the X-direction. Therefore, the (n/2) differential amplifiers 4*a* is connected to the corresponding multiple source lines for the pixels in n columns.

Each of the differential amplifiers 4*a* includes two P-channel transistors 21 and 22 and two N-channel transistors 23 and 24. A first series circuit including the transistors 21 and 23 and a second series circuit including the transistors 22 and 24 are connected in parallel.

The gate terminal of the transistor 21 and the connection point so of the transistors 22 and 24 are connected. The gate terminal of the transistor 22 and the connection point se of the transistors 21 and 23 are connected. The gate terminal of the transistor 23 and the connection point so of the transistors 22 and 24 are connected. The gate terminal of the transistor 24 and the connection point se of the transistors 21 and 23 are connected. The connection points so are connected to the source lines S1, S3, S5, . . . of the pixels in odd-numbered columns. The connection point se is connected to the source lines S2 S4, S6, . . . of the pixels in even-numbered columns. The connection point sp of the transistors 21 and 22 of each of the differential amplifiers 4*a* is connected to a terminal 4*b* for supplying a first driving power SAp-ch of the display data reading circuit portion 4. The connection point sn of the transistors 23 and 24 of each of the differential amplifiers 4*a* is connected to a terminal 4*c* for supplying a second drive Dower SAn-ch of the display data reading circuit portion 4.

When high voltage is supplied to one of the two source lines S connecting to the connection points so and se, that is, the source line S(odd) In an odd-numbered column and the source line S(even) in an even-numbered column, as described later, in the differential amplifier 4*a* serving as a cross-link amplifier functioning as an amplifying unit and low voltage is supplied to the other, the differential amplifier 4*a* operates to decrease the voltage of the source line having the lower voltage and increase the voltage of the source line having the higher voltage in accordance with the potential differences appearing in the two source lines S(odd) and S(even) in the odd-numbered column and even-numbered column. In other words, the differential amplifier 4*a* has a function of amplifying a potential difference of signals input to the connection points so and se.

In the differential amplifier 4*a* in FIG. 3, the connection point sp connecting to the terminal 4*b* is a terminal to which a timing signal for changing the output level to a HIGH signal (simply called HIGH, hereinafter) is input. The connection point sn connecting to the terminal 4*c* is a terminal to which a timing signal for changing the output level to a LOW signal (simply called LOW, hereinafter) is input.

In an operation, the transistor 24 is first turned on where the connection point se has a slightly higher potential than that of the connection point so. As a result, the connection point so falls to a low ground potential of the terminal 4*c* since the transistor 24 is turned on. The transistor 21 having the gate terminal connecting to the connection point so is turned on since the connection point so falls to the low ground potential of the terminal 4*c*. As a result, the connection point se increases to high power voltage Vdd of the terminal 4*b*.

In this way, the differential amplifier 4*a* functions to increase the potential of the source line having a higher potential of two adjacent source lines and decrease the potential of the source line having a lower potential.

According to this embodiment, one differential 29 amplifier 4*a* is provided for two adjacent sources. This is because the differential amplifiers 4*a* are easily provided on the element substrate 1 and extraneous noise if any have an influence on both of the source lines to the same degree. Alternatively, one differential amplifier may be provided for source lines of pixels, which are not adjacent to each other.

According to this embodiments, the electric characteristic of an element substrate itself of the liquid crystal display device, which is an active-matrix display device having the above-described construction, can be evaluated or examined before being bonded to the opposite substrate and filling liquid crystal therebetween where the element substrate is manufactured in manufacturing steps. Failures to be examined with respect to the electric characteristic may include a LOW fixing failure due to a leak in a data holding capacitor (additional capacitor Cs) of each pixel of the element substrate and a HIGH fixing failure due to a source-drain leak of the TFT functioning as a switching element.

First of all, an operation will be described whereby a liquid crystal display device finished by bonding the TFT substrate and opposite substrate shown in FIG. 1 and filling liquid crystal therebetween normally displays an image before describing the examination on the element substrate 1 in a manufacturing process. A pixel data signal including pixel signals for even and odd-numbered columns is first input to the two input terminals ine and ino of the image signal lines 7. The pixel data signals are supplied to the source lines S through the transistors of the transmission gate portion 6 in response to a column select signal from the X-driver 5*a*.

Three pixel signals supplied to the source lines S turn the scan lines G from the Y-driver 5*b* to HIGH and are written in the pixel 2*a* selected thereby. Thus, the pixel data signals supplied to the source lines S in the selected scan lines G are supplied to and held in the corresponding pixels 2*a* as pixel data signals for display. The operation is performed in row order so that a desired image can be displayed on the display element array portion 2 of the liquid crystal display device.

The pre-charge circuit portion 3 is a circuit for applying pre-charge voltage Vpc to each of the source lines S before the scan lines G is turned to HIGH. The pre-charge voltage Vpc is supplied to the terminal 3*a* of the pre-charge circuit portion 3. The timing of the supply of the pre-charge voltage Vpc depends on voltage supplied to the pre-charge gate terminal 3*b*.

Therefore, the display data reading circuit portion 4 of the element substrate 1 does not operate and is not used when the image display is implemented by the liquid crystal display device, which is a product or a prototype.

Next, steps of the examination will be described which are to be performed on the condition of the device substrate 1 after the circuit part shown in FIG. 1 is manufactured by a semiconductor process step. In the examination on the device substrate 1, the display data reading circuit portion 4 operates and is used.

Figure 4:
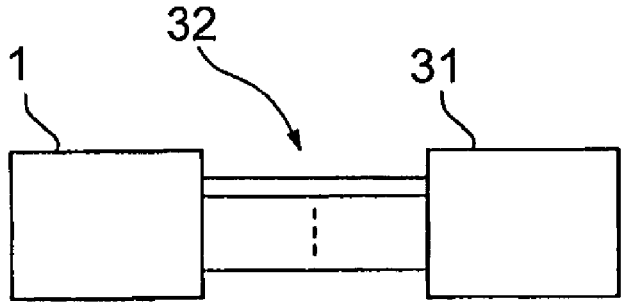
FIG. 4 is a configuration diagram of an examination system according to the first embodiment.

First of all, an examination system for implementing an examination method will be described. FIG. 4 is a configuration diagram of an examination system according to this embodiment. The element substrate 1 and a test device 31 are connected through a connection cable 32. The test device 31 can write and read pixel data. The connection cable 32 may electrically connect the terminals ino and ine of the data line 7 of the element substrate 1, the terminals 4*b* and 4*c* of the signal lines of the display data reading circuit portion 4, terminals 3*a* and 3*b* of the pre-charge circuit portion 3 and so on to the test device 31.

A predetermined amount of voltage is supplied to the terminals in a predetermined order, which will be described later, from the test device 31 so that the electric characteristic of the element substrate 1 can be examined. For describing the details of the examination, the steps of examining the presence of the above-described LOW fixing failure and HIGH fixing failure will be described below.

Figure 5:
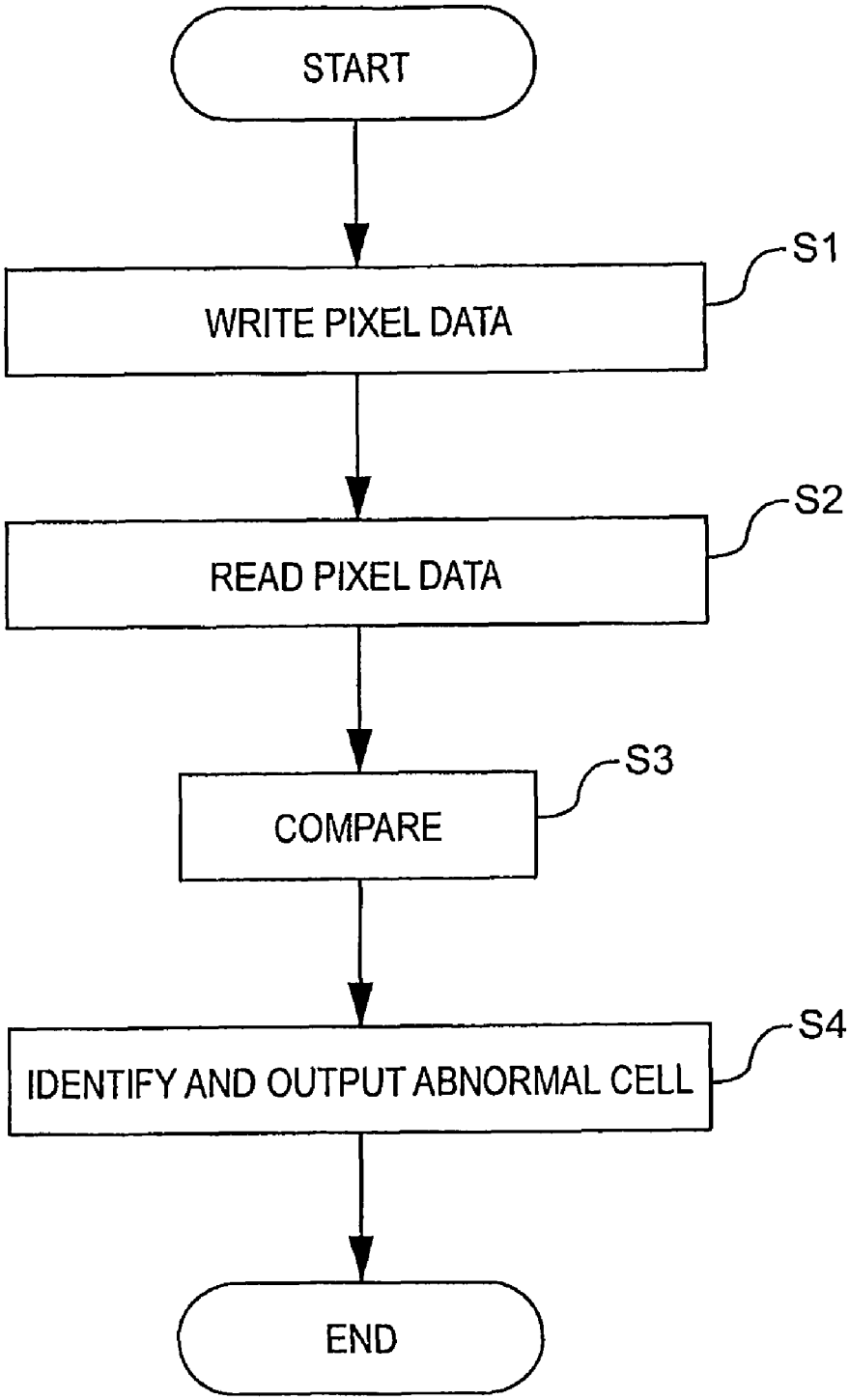
FIG. 5 is a flowchart illustrating an example of the examination flow according to the first embodiment.

Next, a flow of the entire examination will be described. FIG. 5 is a flowchart showing an example of the examination flow.

The differential amplifiers 4*a* of the display data reading circuit portion 4 are inactivated. More specifically, a first driving power SAp-ch and a second driving power SAn-ch are turned to have a middle potential (Vdd/2) of the power supply voltage Vdd and ground potential. Under the condition, a predetermined pixel data signal is input to, that is, written in the pixels, which are cells, from the input terminals ino and ine of the image signal line 7 (step (abbreviated to S hereinafter) 1).

More specifically, HIGH and LOW are supplied to the odd source line S(odd) and even source line S(even), respectively so that HIGH and LOW can be written in the odd numbered and even numbered pixels of a selected row, respectively. This writing step is performed for every row and for all rows. FIG. 6(*a*) is a diagram showing a state with LOW (L) and HIGH (H) of pixel data written in pixels in a 4 (rows)×6 (columns) matrix. As shown in FIG. 6(*a*), the pixel data of the display element array portion 2 has the matrix having alternate columns of LOW (L) and HIGH (H).

Next, written pixel data is read out for every row with the display data reading circuit portion 4 in operation (S2). The operation of the display data reading circuit portion 4 will be described later. As described later, when the display data reading circuit portion 4 operates, the pre-charge period at the beginning is slightly long such that the voltage can be securely varies due to a current leak phenomenon in the data holding capacitor (Cs). In other words, the display data reading circuit portion 4 performs an output step of amplifying and outputting a signal output on a signal line in order to read out pixel data.

Then, the test device 31 compares pixel data read out in the read-out step and pixel data written in the write-in step (S3). In the comparison step, whether the pixel data written in and read out from each of the pixels agree or not is determined.

The test device 31 identifies a cell, that is, a pixel where the written pixel data and read pixel data do not agree and outputs to display the data such as the cell number as an abnormal cell on the screen of a monitor, not shown (S4).

Figure 7:
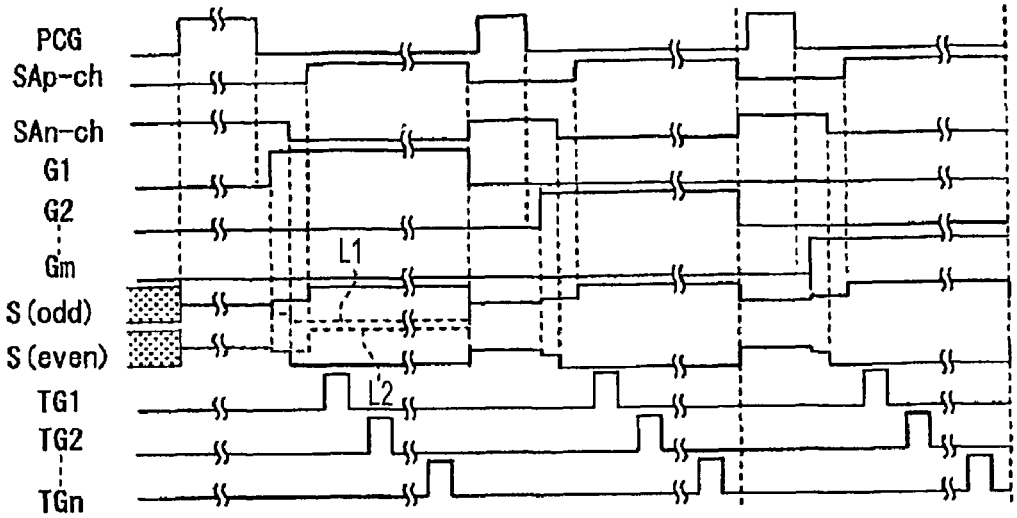
FIG. 7 is a timing chart for explaining a reading operation according to the first embodiment.

Next, the operation for reading out pixel data in S2 in FIG. 5 will be described with reference to the timing chart in FIG. 7. FIG. 7 is a timing chart for explaining a reading operation in the circuit in FIG. 1. The pixel examination is performed by determining whether the column under the examination is normal or not with respect to a reference column. In this case, the reference column is an even-numbered column, and the column under the examination is an odd-numbered column. The signals for the timings shown in FIG. 7 are created by the test device 31 and are supplied to the terminals.

First of all, as shown in FIG. 6(*a*), the pixels in the even-numbered columns are handled for reference data writing, and LOW and HIGH are written in the even-numbered pixels and the odd-numbered-pixels under the examination, respectively, sp that the pixels in the odd-numbered columns under the examination are examined.

As shown in FIG. 7, after the above-described predetermined pixel data is written in all pixels, pre-charge voltage PCG to be supplied to the terminal 3*b* of the pre-charge circuit portion 3 is turned to HIGH to pre-charge the source lines S. After a lapse of a predetermined period of time under the pre-charge state, a reading operation is started. The pre-charge potential of the source lines S (that is, the voltage to be applied to the pre-charge voltage applied terminal 3*a*) Vpc is turned to have the middle potential between HIGH and LOW, and the CsCOM potential shown in FIG. 2 is changed to (LOW potential−ΔV). The CsCOM potential is changed to (LOW potential−ΔV) in order to change the reading potential to be lower than the reference potential. This is because, when the data holding capacitor Cs has a leak failure, the CsCOM potential of the one subject to the leak is (Low potential−ΔV). Defining a slightly long pre-charge period at the beginning thus causes a voltage change due to a leak failure.

In the operation for reading out the first row, the pre-charge gate voltage PCG first turned to LOW to stop pre-charging. Next, the potential of the scan line G1 is turned to HIGH, and the TFTs 11 serving as pixel transistors at the first row are turned ON. The TFTs 11 of all pixels connecting to the scan line G1 are simultaneously turned ON. As a result, the potential written in the capacitor Cs moves to the source lines S. The odd-numbered source lines (S(odd)) in which HIGH is written has a potential slightly increasing to a higher potential near the middle potential while the reference even-numbered source lines (S(even)) has a potential slightly decreasing to a lower potential near the middle potential. The SAn-ch driving power is turned to LOW, and the SAp-ch driving power is then turned to HIGH so that the display data reading circuit portion 4 can be started.

However, when the data holding capacitor Cs of an odd-numbered pixel has a leak, the potential of the odd-number source lines (S(odd)) becomes lower than the potential of the even-numbered source lines (S(even)), as indicated by the dashed line L1 in FIG. 7. As a result, the potential of the even-numbered source lines increases as indicated by the dashed line L2.

The LOW of the SAn-ch driving power turns the potential having a slightly lower potential than the middle potential to LOW, and the HIGH of the SAp-ch driving power then turns the potential having a slightly higher potential than the middle potential to HIGH. This is because, as described above, the operation of the differential amplifiers 4*a* of the display data reading circuit portion 4 can clarify the two high and low potential levels appearing in the two source lines S. This operation is performed simultaneously on all pixels connecting to the scan line G5.

Then, the gates TG1 to TGn of the transistors of the transmission gate portion 6 are sequentially opened (that is, turned to HIGH), and the pixel data of the pixels at the first row are read out in order from the image signal line 7.

After the last transmission gate TGn is opened, the pre-charge operation is started again. In the pre-charge operation, that is, the second and subsequent pre-charge times do not have to be as long as the first one.

Therefore, as described above, the written pixel data and read pixel data are compared (S3). If the written, odd-numbered pixels under the examination, which should have HIGH, have LOW, the odd-numbered pixels can be determined as having a LOW fixing failure. The pixel having a LOW fixing failure, that is, abnormal cell is output from the test device 31 to a display device, for example, not shown (S4).

After the pre-charge operation stops, the potential of the second scan line G2 is changed to have HIGH, and the TFTs 11 of the pixels at the second row are turned ON. The same operation is performed on pixels up to the pixel connecting to the last scan line Gm, that is, to read pixel data of the pixels up to the pixels at the mth row.

The read pixel data and written pixel data are compared so that whether each of the pixels in the odd-numbered column under the examination has a LOW fixing failure or not can be checked.

Next, the relationship between the even-numbered columns and odd-numbered columns is reversed, that is, LOW and HIGH are written in the odd-numbered pixels and the even-numbered pixels under the examination, respectively. The same processing as the processing shown in FIG. 5 is performed so that whether the even-numbered pixels have a LOW fixing failure or not can be checked with respect to the reference odd-numbered pixels.

As described above, the examination for checking whether pixels in one of the odd-numbered and even-numbered columns have a LOW fixing failure or not with reference to the other one is performed on both of the odd-numbered and even-numbered columns so that whether every pixel has a LOW fixing failure or not can be examined.

Figure 8:
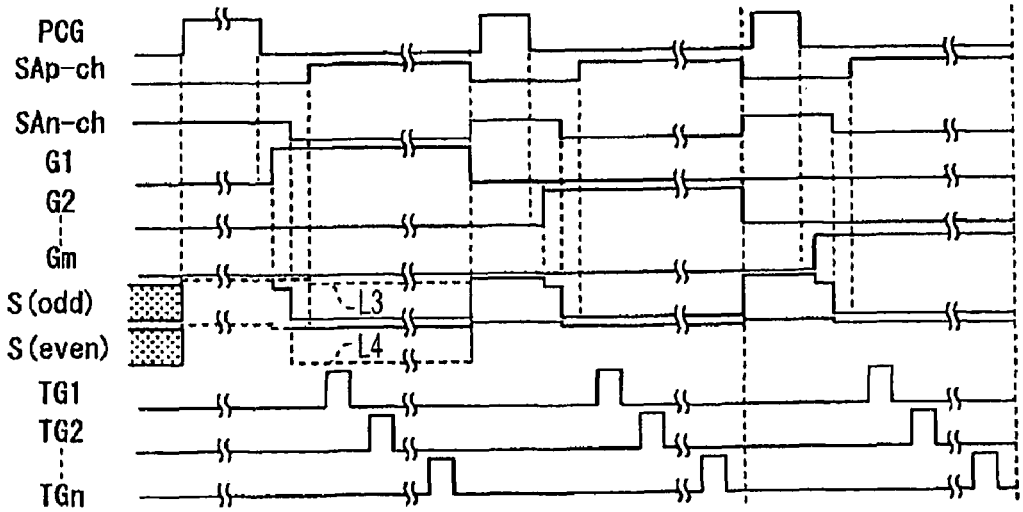
FIG. 8 is a timing chart of another reading operation according to the first embodiment.

Next, the examination of the presence of a HIGH fixing failure will be described with reference to FIG. 8. FIG. 8 is a timing chart for explaining a reading operation in the examination of the presence of a HIGH fixing failure.

Like the examination of a LOW fixing failure, reference data is first written in even-numbered pixels. However, in writing pixel data, HIGH and LOW are written in the even-numbered pixels and the odd-numbered pixels under the examination, respectively.

After the pixel data (that is, pixel data having the reversed relationship between H and L in FIG. 6(*a*)) as shown in FIG. 6(*b*) is written to all pixels, a reading operation is started after a lapse of a predetermined period of time under the pre-charging state. The pre-charge potential (the voltage to be applied to the pre-charge voltage applied terminal 3*a*) Vpc of the source lines S here is changed to (HIGH potential+ΔV). Adopting the potential of (HIGH potential+ΔV) as the pre-charge potential Vpc is for having a higher read-out potential than a reference potential since, when a leak occurs between the source and drain of the TFT 11, the potential of the source line S of the one subject to the leak is (HIGH potential+ΔV).

In the reading operation, the pre-charging is stopped first, and the potential of the scan line G1 is next turned to HIGH to turn of the TFTs 11. The TFTs 11 of all pixels connecting to the scan line G1 are simultaneously turned ON. The potential of the reference even-numbered source lines S(even) to which HIGH is written is changed to have a slightly lower potential than the pre-charge potential Vpc (that is, changed to HIGH potential) while the potential of the odd-numbered source lines S(odd) to which LOW is written is changed to have a much lower potential than the pre-charge potential Vpc. Therefore, the differential amplifier 4*a* lowers the potential of the odd-numbered source lines S(odd) to which LOW is written and maintains the HIGH potential of the even-numbered source lines S(even) to which HIGH is written.

However, when a leak occurs between the source and drain of the TFT 11 of the odd-numbered pixel under the examination, the potential of the capacitor Cs of the pixel subject to the leak is (HIGH potential+ΔV), which is higher than the potential of the reference even numbered pixel. Thus, in reading the pixel data, the potential of the odd-numbered source line S(odd) remains at the pre-charge potential (HIGH potential+ΔV) and does not vary very much as indicated by the dashed line L3 in FIG. 8. In other words, the potential of the odd-numbered source line S(odd) is higher than the potential of the even-numbered source line S(even). Turning the SAn-ch driving power to LOW changes the lower potential to LOW while turning the SAp-ch driving power subsequently to HIGH changes the higher potential to HIGH. As a result, as indicated by the dashed line L4, the potential of the even-numbered source line S(even) is turned to LOW while the potential of the odd-numbered source line S(odd) is turned to HIGH.

Since the written pixel data and the read pixel data are different in the pixel cell under the examination, the abnormal cell can be detected.

The subsequent operation of the differential amplifier is the same as the one for detecting a LOW fixing failure. All pixels can be examined for a HIGH fixing failure by performing the above-described operation on an odd-numbered one as a reference and an even-numbered one as the one to be examined this time.

As described above, all pixels can be examined for the presence of a LOW fixing failure and a HIGH fixing failure by performing examinations of a LOW fixing failure on even-numbered and odd-numbered columns where the reference is switched between the even-numbered and odd-numbered columns for each of the examinations and also by performing examinations of a HIGH fixing failure on even-numbered and odd-numbered columns where the reference is switched between the even-numbered and odd-numbered columns for each of the examinations.

Though HIGH or LOW is written in reference pixels for an examination in this example, a signal of the middle potential may be written in the reference pixels.

Figures 9, 10:
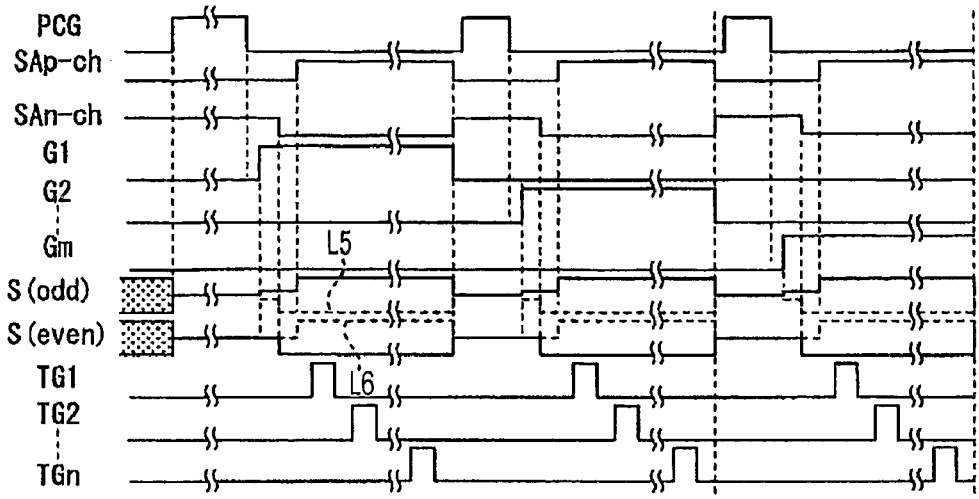
FIG. 9 is a timing chart of another reading operation according to the first embodiment.
FIG. 10 is a diagram showing a state example of pixel data written in pixels.

With reference to FIG. 9, a method will be described in which the middle potential of HIGH and LOW is written in the reference pixels for an examination.

Like the detection of a LOW fixing failure, reference data is first to be written in even-numbered pixels, and the middle potential of HIGH and LOW is written in the even-numbered pixels while HIGH or LOW is written in odd-numbered pixels to be examined. For example, as shown in FIG. 10, HIGH is first written in the odd-numbered pixels, and the middle potential (M) of HIGH and LOW is written in the even-numbered pixels.

After a lapse of a predetermined period of time at a pre-charge state after writing in all pixels, a reading operation is started. Here, the pre-charge potential of the source line S (voltage to be applied to the pre-charge voltage applied terminal 3*a*) is turned to the middle potential of HIGH and LOW.

In the reading operation, the pre-charging is stopped first, and the potential of the scan line G1 is next turned to HIGH, which turns ON the TFTs 11. The TFTs 11 are turned ON simultaneously in all pixels connecting to the scan line G1. The potential of the reference even-numbered source line remains at the middle potential of the pre-charge potential and does not vary. The potential of the odd-numbered source line S becomes slightly higher than the middle potential since HIGH is written therein Thus, the differential amplifiers 4*a* turn the even-numbered side and odd-numbered side to LOW and HIGH, respectively, which means that the pixel data written in the odd-numbered side is left as HIGH.

However, when a leak occurs in a capacitor Cs of a pixel under the examination, the potential of the odd-numbered source line S(odd) becomes slightly lower than the middle potential. Thus, the differential amplifier 4*a* turns the odd-numbered side to LOW as indicated by the dashed line L5 in FIG. 9 and the even-numbered side to HIGH as indicated by the dashed line L6, which means that the pixel data written in the odd-numbered side becomes LOW instead of HIGH.

The subsequent operation is the same as the one for the detection of a LOW fixing failure. Subsequently, pixel data is read out from all rows in the same manner.

Next, LOW is written in the odd-numbered side (see the state resulting from a change from H to L in FIG. 10), and the middle potential is written in the reference even-numbered side. The same operation as the operation of writing HIGH in the odd-numbered side and reading out the pixel data is performed on all pixels sequentially.

As a result, the test device 31 can obtain data resulting from writing HIGH and LOW in the ones to be examined and reading out the pixel data in both cases. The pixel data having HIGH and LOW written and the read pixel data in both cases are compared. In this case, every time LOW is read out from a pixel, it may be first considered that the pixel has a leak failure in the capacitor Cs in both cases that LOW and HIGH are written in the pixel.

The high resistance at the capacitor or TFT or the source-drain leak of the FT turns the source-line potential under the examination to the pre-charge potential, that is, leads the implementation of the comparison on the pre-charge potential instead of the read-out and amplifying operation. For this, it can be determined that the side under the examination may always lean toward LOW due to the characteristic inherent to the circuit.

HIGH read in both cases only eliminates the possibility of a leak failure in the capacitor Cs and may still exhibit the same possibility of a failure as that of LOW. In other words, a failure in a capacitor Cs or a TFT of a cell can be detected by writing the middle potential in the reference side and writing LOW and HIGH in the other side to be examined (where LOW or HIGH may be written first), reading out pixel data in both cases and comparing them.

Then, all pixels can be examined for th presence of a failure in a capacitor Cs or TFT therein by next performing the same examination on an odd-numbered column handled as the reference side and an even-numbered column handled as the other side to be examined.

As described above, with the operation shown in FIG. 9, data having HIGH and LOW are fixed to LOW or HIGH when read, it can be determined that the capacitor Cs or TFT has some failure.

Figure 11:
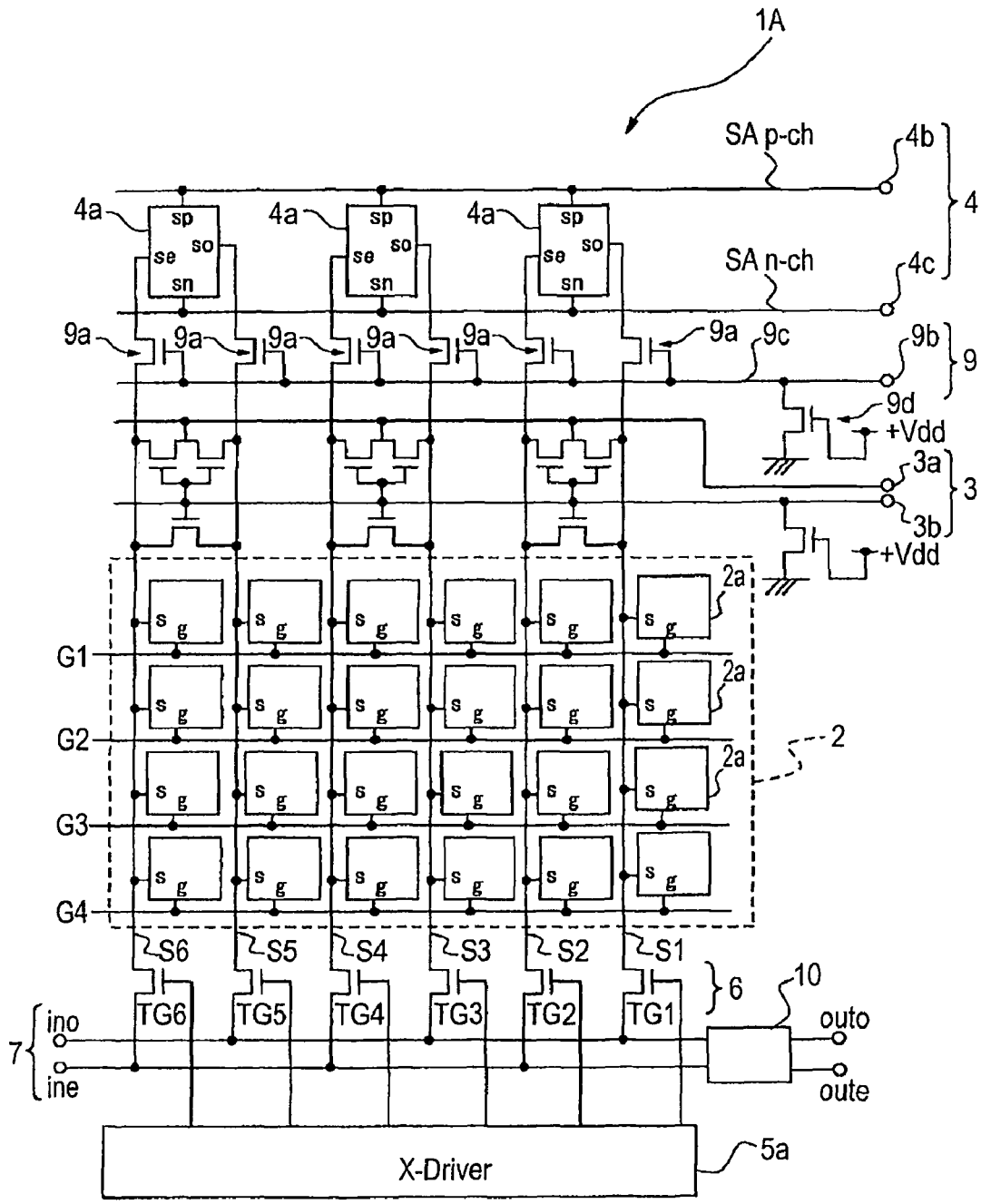
FIG. 11 is a circuit diagram showing a variation example of the circuit of the element substrate according to the first embodiment.

FIG. 11 is a circuit diagram showing a variation example of the circuit of the element substrate shown in FIG. 1. In FIG. 1, the display data reading circuit portion 4 of the element substrate 1A is provided between the source line S output from the pre-charge circuit portion 3 and the transmission gate portion 7. In FIG. 11, the display data reading circuit portion 4 is connected to the source line S output from the pre-charge circuit portion 3 through a connection gate portion 9.

In the construction shown in FIG. 11, the gate terminals of the transistors 9*a* of the transmission gate portion 9 are connected to a connection gate terminal 9*b* through a signal line 9*c*. Generally, regarding the potential of the connection gate terminal 9*b*, the signal line 9*c* is LOW since the gate terminal of the transistor 9*d* is HIGH, and the display data read circuit portion 4 is isolated from the source lines. Thus, the display data reading circuit portion 44 may be advantageously completely isolated in the construction in FIG. 11 when not in use so that the influence of an unstable operation state of the differential amplifiers 4*a* cannot be given thereto.

In the reading operation, the display reading circuit portion 4 can be operated by controlling the potential of the connection gate terminal 9*b* so as to turn the signal line 9 to HIGH.

The image signal line 7 includes a differential amplifier 10 including a current mirror amplifier. This is for preventing the difference between HIGH and LOW signals from decreasing due to the capacitance component that the image signal line 7 itself has, for example. Therefore, the HIGH and LOW signals can be more clarified, and the output signals outo and oute can be output fast with high accuracy.

Though the display data reading circuit portion is provided for all pixels of the display element array portion in this embodiment, but the display data reading circuit portion may be provided for some pixels to be used as a display portion rather than all of them.

As described above, according to the embodiment and variation example of the present invention, a failure in an element substrate can be detected after the completion of the element substrate steps of a product or a prototype. Therefore, the low yield period can be reduced, which can reduce the assembly of poor products and can thus reduce the costs. In particular, the development period and development costs can be reduced for a prototype.

Furthermore, since a failure can be detected in the element substrate stage, a so-called repair thereof can become easier.

Furthermore, since charges charged in a capacitor, which are analog information, can be converted to digital information (voltage logic) by the display data reading circuit portion, the sensitivity of the detection in examinations can be high.

Furthermore, though, in this example, a differential amplifier is connected to adjacent source lines so as to hardly being subject to outside noise, a differential amplifier connecting to source lines, which are not adjacent to each other, may be provided. Thus, the influence of the possibility of a leak between adjacent source lines can be eliminated.

Second Embodiment

Figure 12:
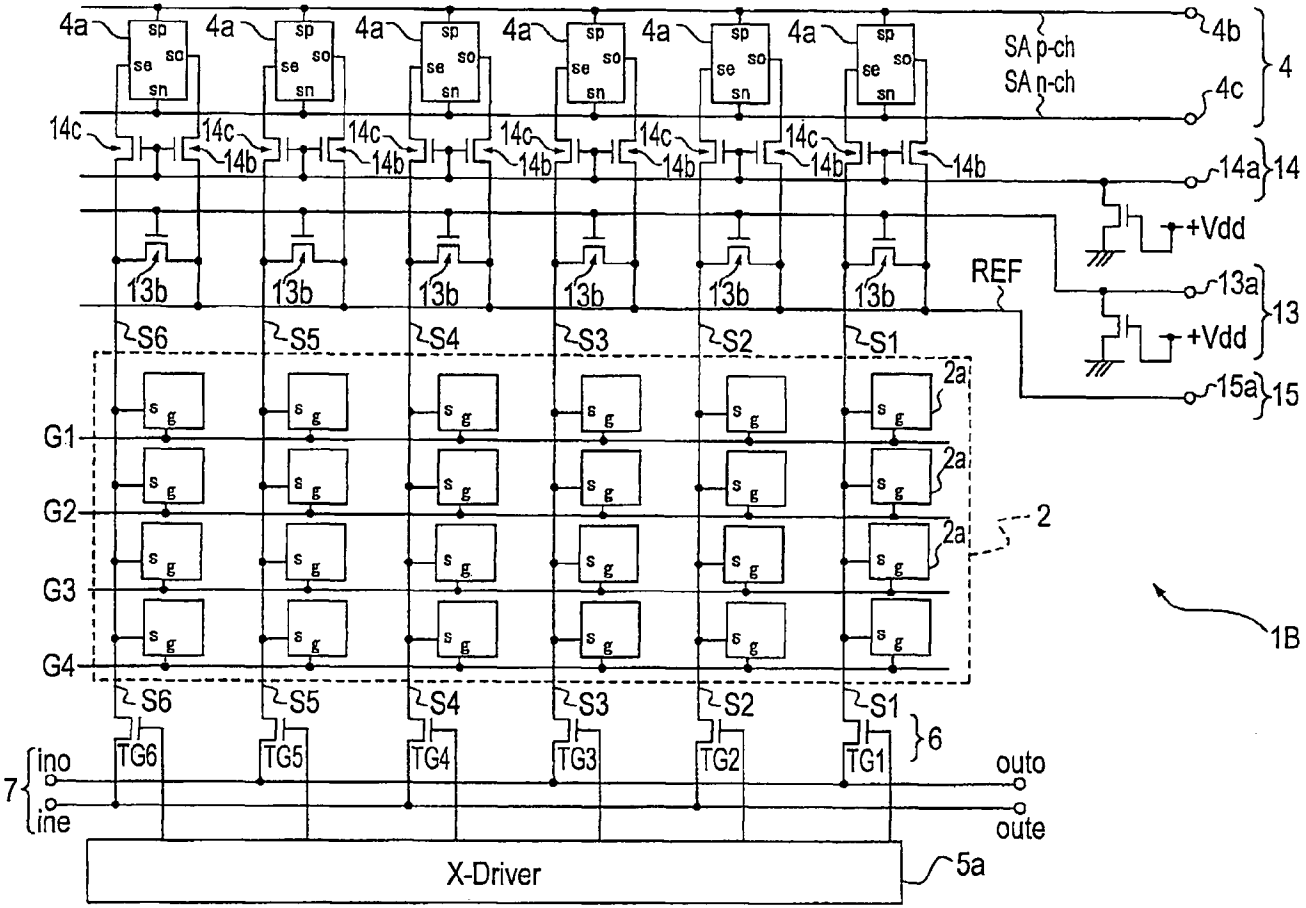
FIG. 12 is a circuit diagram of an element substrate of a liquid crystal display device according to a second embodiment of the invention.

Next, a second embodiment of the present invention will be described. FIG. 12 is a circuit diagram of an element substrate of a liquid crystal display device according to the second embodiment of the present invention. In FIG. 12, the same reference numerals are given to the same components as those of the first embodiment, and the description thereof will be omitted herein.

An element substrate 1B of the liquid crystal display device according to this embodiment also includes the display element array portion 2, the display data reading circuit portion 4, the X-driver portion 5*a*, the Y-driver portion 5*b* (not shown in FIG. 12) the transmission gate portion 6, the image signal line 7, and the differential amplifier 10. According to this embodiment, the element substrate 1B further includes a pre-charge circuit portion 13, a connection gate portion 14 and a reference voltage supplying portion 15.

The pre-charge circuit portion 13 of the second embodiment has a transistor 13*b* in each column, that is, in each source line. The source and drain of each of the transistors 13*b* connect to the connection point se of each differential amplifier 4*a* through a source line S and the connection point so of the differential amplifier 4*a* through a reference voltage supplying line REF. The gate of each of the transistors 13*b* is connected to a gate terminal 13*a* for pre-charging.

In the connection gate portion 14, one connection point so of each of the differential amplifiers 4*a* is, as shown in FIG. 12, connected to a terminal 15*a* of the reference voltage supplying portion 15 through one transistor 14*b* of the connection gate portion 14 and the reference voltage supplying line REF. Reference voltage Vref is supplied to the terminal 15*a*. The other connection point se of each of the differential amplifiers 4*a* is connected to the source line S through the other transistor 14*c* of the connection gate portion 14. The gates of the transistors 14*b* and 14*c* are connected to a gate terminal 14*a* for test circuit connection. A test circuit connection signal TE, which Will be described later, is supplied to the gate terminal 14*a*.

The transistors 13*b* for pre-charging are connected to the reference voltage supplying line REF connecting to the terminal 15*a* of the reference voltage supplying portion 15. Thus, the gate voltage of the transistors 13*b* is controlled so that the transistors 13*b* can be turned on and the reference voltage Vref can be applied to the source lines S through the transistors 13*b*.

Figure 13:
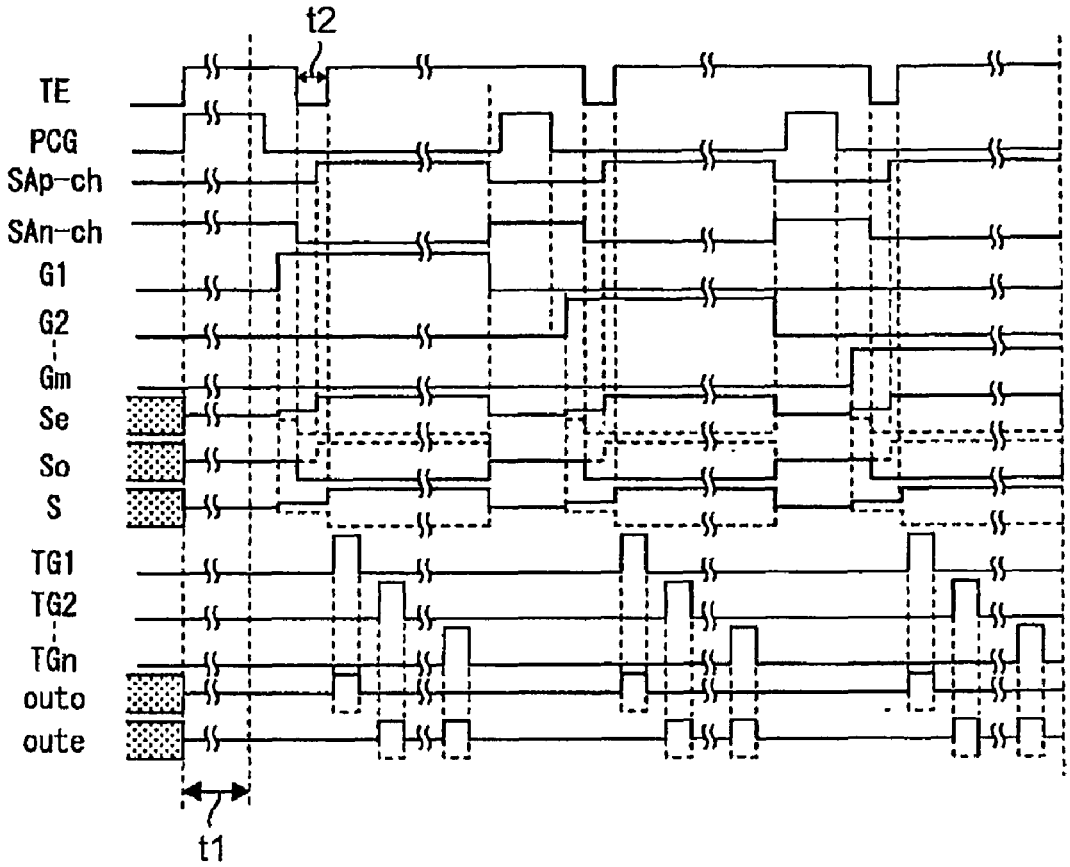
FIG. 13 is a timing chart for explaining a reading operation according to the second embodiment.

Next, an operation of reading out pixel data in S2 in FIG. 5 will be described with reference to a timing chart in FIG. 13. FIG. 13 is a timing chart for explaining a reading operation in the circuit in FIG. 12. The examination on pixels is implemented by determining whether each of the columns is normal or not. The signals for timings shown in FIG. 13 are generated by the test device 31 and are supplied to the terminals.

First of all, all scan lines G of the element array portion 2 are turned on, and HIGH is written in all pixels. Though HIGH is written in each pixel in this case for description, LOW may be written therein. Though an example in which HIGH is written in all pixels to examine the substrate 1B will be described hereinafter, the examination may be performed on partial pixels. The gates of the scan lines G are turned off after writing.

As shown In FIG. 13, after the predetermined pixel data (HIGH herein) is written in all pixels, the pre-charge gate voltage PCG to be supplied to the terminal 13*a* of the pre-charge circuit portion 13 is turned to HIGH for securing a data holding time t1, and the transistor 13*b* is turned on for a predetermined period of time. Furthermore, the test circuit connection signal TE of the gate terminal 14*a* for test circuit connection is turned to HIGH. After a lapse of the data holding time t1, reading the pixel data is started.

The gate lines G are kept OFF and do not always have to be the pre-charge state since the transistors 13*b* are turned on for a predetermined period of time so that the reference voltage Vref can appear in both of the source lines S and the reference side signal line REF. When the transistors 13*b* are turned on, the test circuit connection signal TE of the gate terminal 14*a* for test circuit connection does not have to be HIGH yet. Therefore, after a lapse of the data holding time t1, the pre-charge gate voltage PCG is turned to HIGH if it is LOW to perform pre-charging.

The reference voltage Vref at the middle potential of HIGH and LOW is applied as a pre-charge potential from the reference voltage supplying portion 15 to the terminal 15*a*. Thus, after writing predetermined pixel data, the source lines S and the connection point se and connection point so have the middle potential.

Then, after a lapse of the data holding time t1, the pre-charge gate voltage PCG is turned to LOW for canceling the pre-charge state. In this case, the test circuit connection signal TE is kept HIGH, and the potentials of the first driving power SAp-ch and second driving power SAn-ch are kept being the middle potential so that the differential amplifiers 4*a* can be prevented from operating.

Notably, the supply of pre-charge gate voltage to the terminal 15*a* is terminated before the operation of the differential amplifiers 4*a* is started after the pre-charge gate voltage PCG is turned to LOW.

When the gate line G1, is turned on immediately after the pre-charge gate voltage PCG is turned to LOW, data is output simultaneously from the pixels connecting to the gate line G1. More specifically, charges written and held in the capacitors Cs are moved simultaneously to the respective source lines S. As shown in FIG. 13, the potential of the source lines S slightly increases. If a leak in the capacitors Cs changes data of each of the pixels to LOW, the potential, of the source lines S slightly decreases as indicated by the dashed line.

In order to operate the differential amplifiers 4*a* after a lapse of a predetermined period of time after the gate line G1 is opened, the potential of the second driving power SAn-ch is first changed from the middle potential to LOW. Simultaneously or in neighborhood of the instance of the change of the potential of the second driving power SAn-ch to LOW, the test circuit connection signal TE is turned to LOW, and the transistors 14*b* and 14*c* of the connection gate portion 14 are turned off for a predetermined period of time t2 so that the information on the slightly increased source line potential is confined in the differential amplifiers 4*a*.

Turning the SAn-ch driving power to LOW changes the potential, which is slightly lower than the middle potential, to LOW. Thus, each of the differential amplifiers 4*a* compare the reference voltage Vref, which is the middle potential applied from the outside, and the voltage of the corresponding source line S. If the pixels are normal, the potential of the source line S is slightly higher than the middle potential. Therefore, the connection point so of each of the differential amplifiers 4*a* has a lower potential than that of the connection point se. As a result, as shown in FIG. 13, the potential of the connection point so decreases. Here, the potential of the connection point se is left as it is.

Next, turning the SAp-ch driving power to HIGH operates P-channel transistors 21 and 22 of each of the differential amplifiers 4*a*. In other words, turning the SAp-ch driving power to HIGH changes the potential, which is slightly higher than the middle potential, to HIGH. If the pixels are normal, the potential of the source lines S is slightly higher than the middle potential. Thus, the connection points se of the differential amplifiers 4*a* have a higher potential than the connection points so. Therefore, as shown in FIG. 13, the potential of the connection points se increases.

If the pixels have a failure, for example, if a leak in a capacitor Cs changes the data in each pixel to LOW, the potential of the source lines S is slightly decreased as indicated by the dashed line in FIG. 13. In this case, when the SAn-ch driving power is turned to LOW, the potential of the connection points se decreases as indicated by the dashed line in FIG. 13. Furthermore, when SAp-ch driving power is turned to HIGH, the potential of the connection points so increases as indicated by the dashed line in FIG. 13.

In this case, a fast operation is possible without any influence of the capacity, which is a load, of the source lines S since the test circuit connection signal TE is off. Furthermore, since the reference voltage Vref does not have the potential written in the pixels, a failure in a pixel is detected as a failure in the pixel. In other words, since it can be identified as a failure in one pixel, the failure characteristic can be categorized in detail.

When the logic of the connection points se and connection points so of the differential amplifiers 4*a* are fixed to either one of HIGH and LOW, the test circuit connection signal TE is turned to HIGH, and the fixed logic data is rewritten in the source lines S.

Since the potential of each pixel connecting to the gate line G1 is read out to each corresponding source line S, the gates TG1 to TGn of the transistors of the transmission gate portion 6 are opened (that is, turned to HIGH). Then, the pixel data of the pixels at the first row is read out in order from the image signal line 7 and is output to the output terminals outo and oute.

After the data of all pixels connecting to the gate line G1 is read out, the gate line G1 is turned to LOW, and the SAn-ch driving power and SAp-ch driving power are changed to have the middle potential to stop the operation of the differential amplifiers 4*a*. Then, the pre-charge gate voltage PCG is turned to HIGH, and all of the source lines S are pre-charged.

Subsequently, the operation is repeated on all of the gate lines G2 to Gm so that the pixels on the substrate can be examined sequentially.

Subsequent to the end of the examination operation performed by writing HIGH data to all pixels as described above, LOW data is written in all pixels and the same examination is performed thereon, whereby all examinations are completed. Therefore, the examination time is shorter than that of the first embodiment since only two examinations are needed on all pixels.

As described above, according to this embodiment, the pixels requiring examinations can be examined with respect to the presence of a failure therein unlike the first embodiment.

Variation Example

Figure 14:
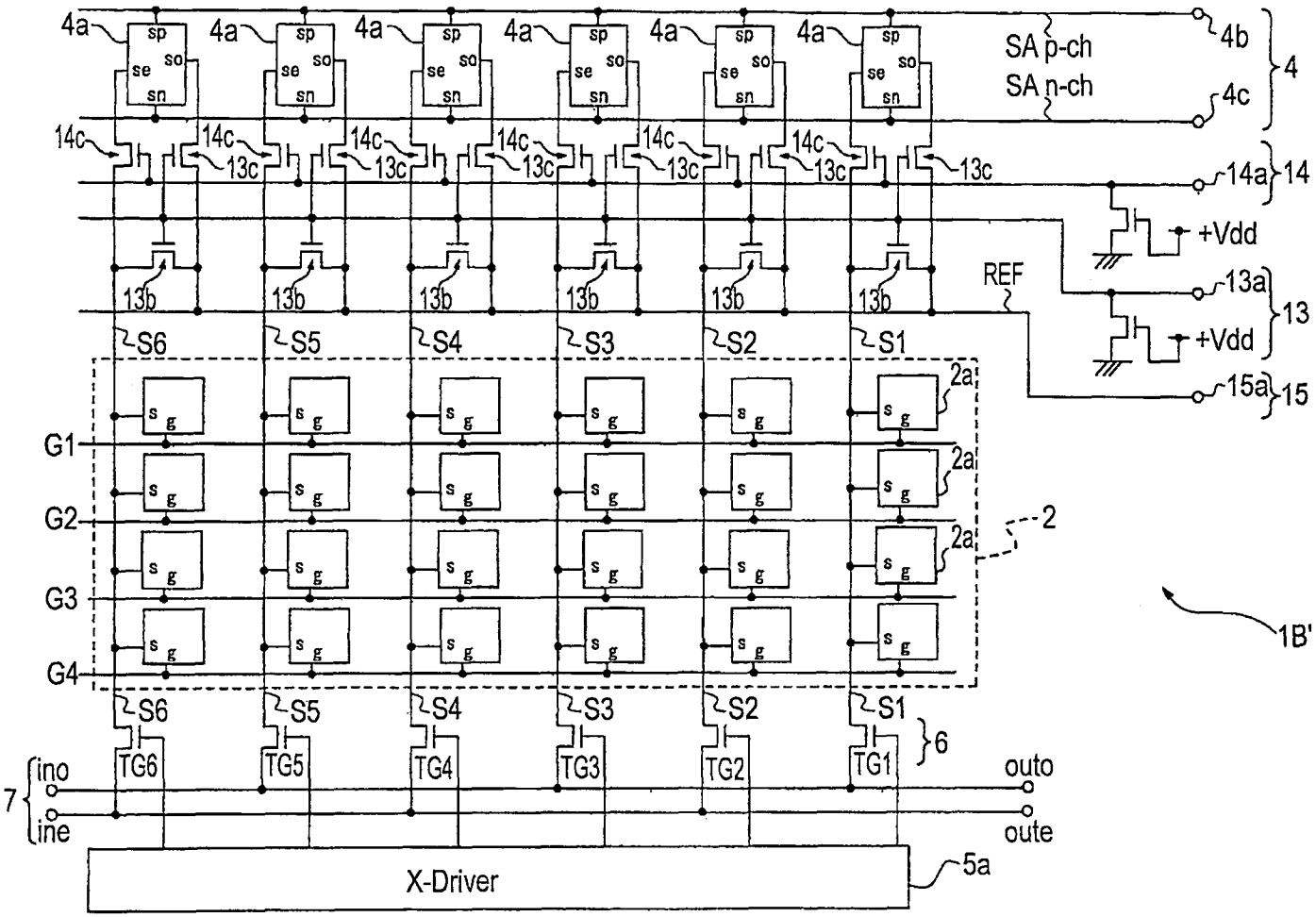
FIG. 14 is a circuit diagram of an element substrate of a variation example of the second embodiment.

Next, a variation example of the second embodiment will be described. FIG. 14 shows an element substrate 1B' according to a variation example of the second embodiment. In FIG. 14, the same reference numerals are given to the same components as those in FIG. 12, and the description thereof will be omitted herein.

The pre-charge circuit portion 13 of the second embodiment has transistors 13*b* and 13*c* in each column, that is, in each source line. The drain and source of each of the transistors 13*b* are connected to the connection point se of the differential amplifier 4*a* and the terminal 15*a* of the reference voltage supplying portion 15. Furthermore, the source and drain of each of the transistors are connected to the terminal 15*a* of the reference voltage supplying portion 15 and the connection point so of the differential amplifier 4*a*. Reference voltage Vref is supplied to the terminal 15*a*. The gate of each of the transistors 13*b* and 13*c* is connected to the gate terminal 13*a* for pre-charging.

In the connection gate portion 14, the connection point se of each of the differential amplifiers 4*a* is connected to each corresponding source line S through the transistor 14*c* of the connection gate portion 14. The gate of each of the transistors 14*c* is connected to the gate terminal 14*a* for test circuit connection. A test circuit connection signal TE, which will be described later, is supplied to the gate terminal 14*a*.

The transistors 13*b* and 13*c* for pre-charging are connected to the reference voltage supplying line REF connecting to the terminal 15*a* of the reference voltage supplying portion 15. Thus, the gate voltage of the transistors 13*b* and 13*c* is controlled so that the transistors 13*b* and 13*c* can be turned on. Furthermore, the gate voltage of the transistors 14*c* connecting to the test circuit connection gate terminal 14*a* is controlled so that the transistors 14*c* can be turned on. Therefore, the reference voltage Vref can be applied to the source lines S and the connection points se and so of the differential amplifiers 4*a* through the transistors 13*b*, 13*c* and 14*c*.

Under this construction, unlike the element substrate 1B in FIG. 12, the switch for controlling the supply or termination of pre-charge gate voltage to the terminal 15*a* is not required after the pre-charge gate voltage PCG is turned to LOW.

Also in this variation example, the operation in accordance with the timing chart shown in FIG. 13 is performed. This variation example is different from the embodiment in FIG. 12 only in the operations of the transistors 13*b*, 13*c* and 14*c*.

In other words, after the predetermined pixel data (HIGH herein) is written in all pixels, the pre-charge gate voltage PCG to be supplied to the terminal 13*a* of the pre-charge circuit portion 13 is turned to HIGH for securing the data holding time t1, and the transistors 13*b* and 13*c* are turned on for a predetermined period of time.

Furthermore, the test circuit connection signal TE of the gate terminal 14*a* for test circuit connection is turned to HIGH. After a lapse of the data holding time t1, reading the pixel data is started.

Note that the date lines G may be kept OFF and do not always have to be the pre-charge state therefor though the transistors 13*b* and 13*c* and the test circuit connection signal TE of the gate terminal for test circuit connection are turned to HIGH so that the reference Vref appears in the source lines S and the connection points se and so of the differential amplifiers 4*a*. Therefore, after a lapse of the data holding time t1, the pre-charge gate voltage CG is turned to HIGH if it is LOW and the test circuit connection signal TE is turned to High if it is Low to perform pre-charging.

In order to operate the differential amplifiers 4*a* after a lapse of a predetermined period of time after the gate line G1 is opened, the potential of the second driving power SAn-ch is first changed from the middle potential to LOW. Simultaneously or in neighborhood of the instance of the change of the potential of the second driving power SAn-ch to LOW, the test circuit connection signal TE is turned to LOW, and the transistors 14*c* of the connection gate portion 14 are turned off for the predetermined period of time t2 so that the information on the slightly increased source line potential is confined in the differential amplifiers 4*a*.

The other operations are the same as those of the embodiment in FIG. 12.

Third Embodiment

Figure 15:
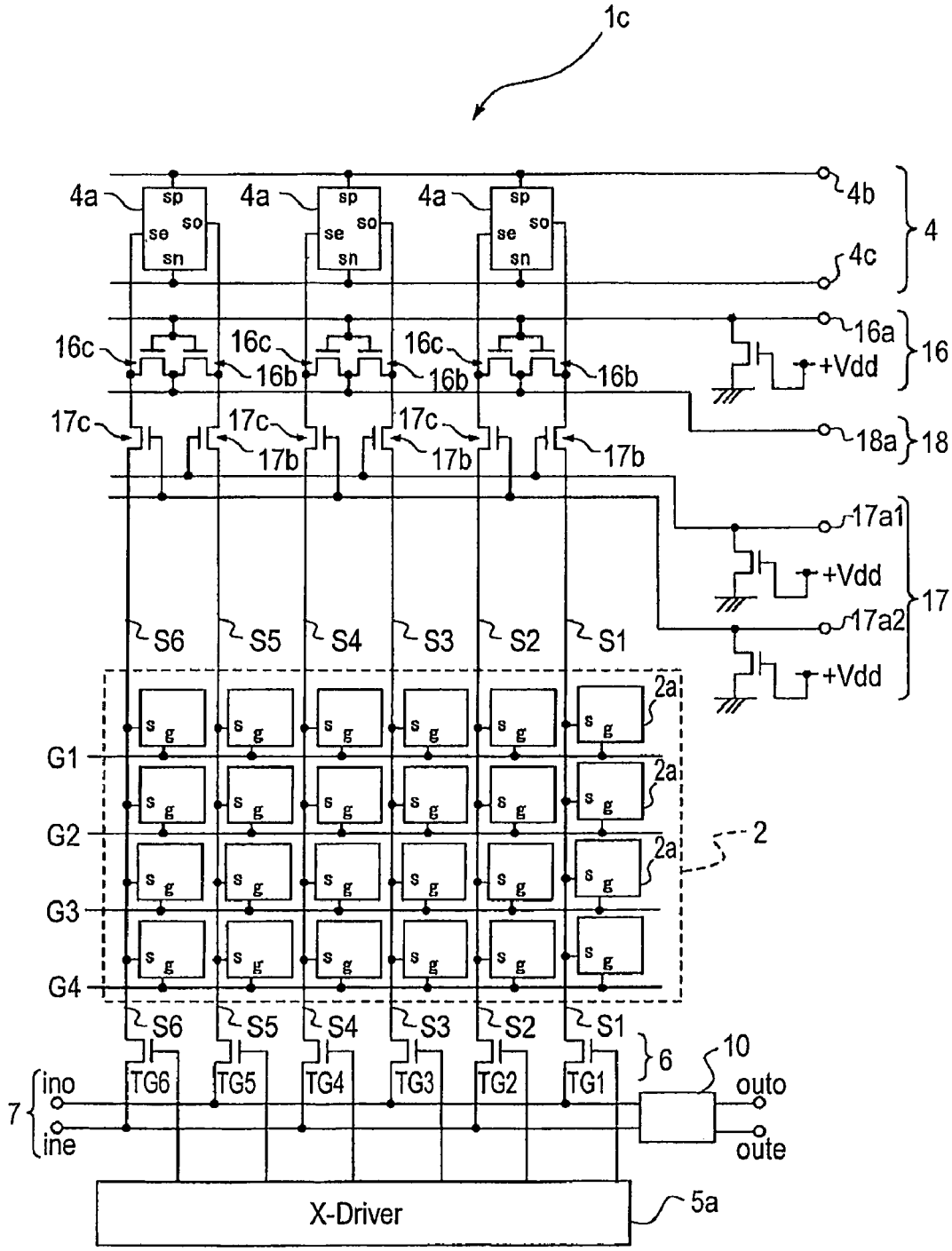
FIG. 15 is a circuit diagram of an element substrate of a liquid crystal display device according to a third embodiment of the invention.

Next, a third embodiment of the present invention will be described. FIG. 15 is a circuit diagram of an element substrate of a liquid crystal display device according to the third embodiment of the present invention. In FIG. 15, the same reference numerals are given to the same components as those of the first embodiment, and the description thereof will be omitted herein.

An element substrate 1C of the liquid crystal display device according to this embodiment also includes the display element array portion 2, the display data reading circuit portion 4, the X-driver portion 5*a*, the Y-driver portion 5*b* knot shown in FIG. 15), the transmission gate portion 6, the image signal line 7, and the differential amplifier 10. According to this embodiment, the element substrate 1C further includes a pre-charge circuit portion 16, a connection gate portion 17 and a reference voltage supplying portion 18.

The pre-charge circuit portion 16 of the third embodiment has a pair of transistors 16*b* and 16*c* in a pair of source lines of a source line S(odd) in an odd-numbered column and a source line S(even) in an even-numbered column. The source and drain of each of the transistors 16*b* and 16*c*, the source and drain of which are connected in series, connect to the connection points so and se of each differential amplifier 4*a* through the odd-numbered source line S(odd) and the even-numbered source line S(even). The gate of each of the transistors 16*b* and 16*c* is connected to a gate terminal 16*a* for pre-charging. The connection Points of the transistors 16*b* and 16*c* are connected to a terminal 18*a* of the reference voltage supplying portion 18. Reference voltage Vref is supplied to the terminal 18*a*. Thus, the gate voltage of the transistors 16*b* and 16*c* is controlled so that the transistors 16*b* and 16*c* can be turned on. Therefore, the reference voltage Vref supplied from the outside of the element substrate 1C can be applied to the source lines through the transistors 16*b* and 16*c*. Notably, the reference voltage Vref may be generated within the element substrate 1C. The reference voltage Vref is voltage at the middle potential between HIGH and LOW.

In the connection gate portion 17, one connection point so of each of the differential amplifiers 4*a* is, as shown in FIG. 15, connected to the odd-numbered source S(odd) through one transistor 17*b* of the connection date portion 17. The other connection point se of each of the differential amplifiers ala is connected to the even-numbered source line S(even) through the other transistor 17*c* of the connection gate portion 17. The gates of the transistors 17*b* and 17*c* are connected to a gate terminal 17*a*1 for odd-numbered test circuit connection a gate terminal 17*a*2 for even-numbered test circuit connection. Test circuit connection signals TEo and TEe and, which will be described later, are supplied to the gate terminals 17*a*1 and 17*a*2.

Hence, with either one of the test circuit connection signals TEo and TEe turned to HIGHS the data of either one of pixels in the odd-numbered source line S(odd) and in the even-numbered source line S(even) can be only read out by one differential amplifier 4*a*. Then, the potential (slight potential change) appearing in and read out from the source line 5 is transmitted to the differential amplifier 4*a* through either one transistor of the transistors 17*b* and 17*c*. The potential is amplified within the differential amplifier 4*a* after the transistor turned on and opened is closed once. Then, the transistor closed once is opened again and rewritten in the source line, and the potential is output through the image signal line 7.

Figure 16:
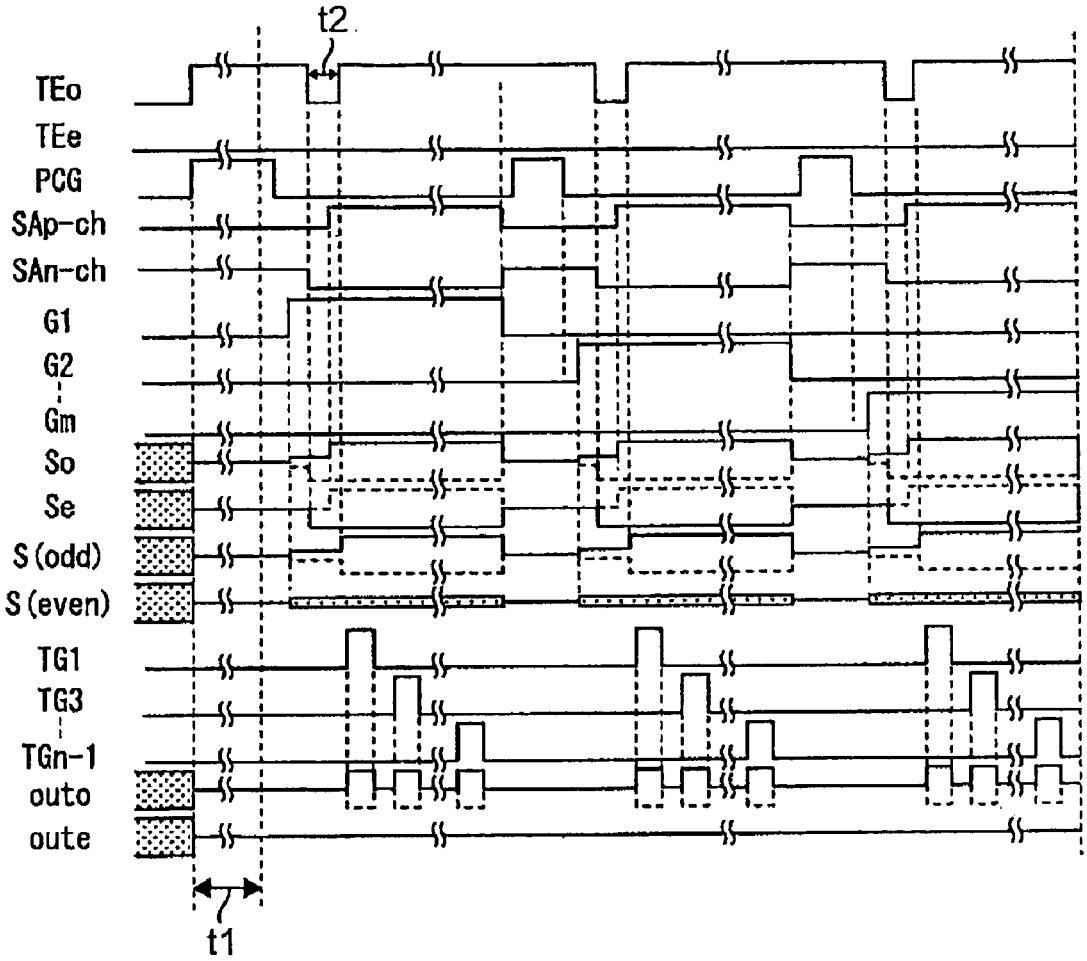
FIG. 16 is a timing chart for explaining a reading operation according to the third embodiment.

Next, an operation of the circuit shown in FIG. 15 will be described with reference to a timing chart in FIG. 16. The operation for reading out pixel data in S2 in FIG. 5 will be described. FIG. 16 is a timing chart for explaining a reading operation in the circuit in FIG. 1. The examination on pixels is implemented by determining whether each of the columns, that is, an odd-numbered column and an even-numbered column separately here, is normal or not. The signals for timings shown in FIG. 16 are generated by the test device 31 and are supplied to the terminals.

First of all, all scan lines G of the element array portion 2 are turned on, and HIGH is written in all pixels in an odd-numbered column. Notably, HIGH may be written in all pixels. In this embodiment, the examination on pixels in an odd-numbered source line S(odd) and the examination on pixels in even-numbered source line S(even) are performed separately. Though HIGH is written in each pixel in this case for description, LOW may be written therein. Though an example in which HIGH is written in all pixels in an odd-numbered column to examine the substrate 1C will be described hereinafter, the examination may be performed on partial pixels. The gates of the scan lines G are turned off after writing. Turning the test circuit connection signal TEe to LOW prevents the transmission of the influence of the potential from the display element array portion 2 to an even-numbered source line S(even) through the differential amplifier 4*a*.

As shown in FIG. 16, after the predetermined pixel data (HIGH herein) is written in pixels in the odd-numbered column, the pre-charge gate voltage PCG to be supplied to the terminal 16*a* of the pre-charge circuit portion 16 is turned to HIGH for securing a data holding time t1, and the transistors 16*b* and 16*c* are turned on for a predetermined period of time. Furthermore, the test circuit connection signal TEo of the gate terminal 17*a*1 for test circuit connection is also turned to HIGH. After a lapse of the data holding time t1, reading the pixel data is started.

The gate lines G are kept OFF and do not always have to be the pre-charge state since the transistors 16*b* and 16*c* are turned on for a predetermined period of time so that the reference voltage Vref can appear in both of the connection points so and se of the differential amplifiers 4*a*. When the transistors 16*b* and 16*c* are turned on, the test circuit connection signal TEo of the gate terminal 17*a*1 for test circuit connection does not have to be HIGH yet. Therefore, after a lapse of the data holding time t1, the pre-charge gate voltage PCG is turned to HIGH if it is LOW to perform pre-charging.

The reference voltage Vref at the middle potential of HIGH and LOW is applied as a pre-charge potential from the reference voltage supplying portion 18 to the terminal 18*a*. Thus, after writing predetermined pixel data, the source line S(odd) and the connection point se and connection point so have the middle potential.

Then, after a lapse of the data holding time t1, the pre-charge gate voltage PCG is turned to LOW for canceling the pre-charge state. In this case, the test circuit connection signal TEo is kept HIGH, and the potentials of the first driving power SAp-ch and second driving power SAn-ch are kept being the middle potential so that the differential amplifiers 4*a* can be prevented from operating.

When the gate line G1 is turned on immediately after the pre-charge gate voltage PCG is turned to LOW, data is output simultaneously from the pixels connecting to the gate line G1. More specifically, charges written and held in the capacitors Cs are moved simultaneously to the respective source lines S(odd). As shown in FIG. 16, the potential of the source lines S(odd) slightly increases. If a leak in the capacitors Cs changes data of each of the pixels to LOW, the potential of the source lines S(odd) slightly decreases as indicated by the dashed line. In this case, the potential of even-numbered source lines S(even) is ignorable since the test circuit connection signal TEe is LOW.

In order to operate the differential amplifiers 4*a* after a lapse of a predetermined period of time after the gate line G1 is opened, the potential of the second driving power SAn-ch is first changed from the middle potential to LOW. Simultaneously or in neighborhood of the instance of the chance of the potential of the second driving power SAn-ch to LOW, the test circuit connection signal TEo is turned to LOW, and the transistors 17*b* of the connection gate portion 17 are turned off so that the information on the slightly increased potential of the odd-numbered source line S(odd) is confined in the differential amplifiers 4*a*.

Turning the SAn-ch driving power to LOW changes the potential, which is slightly lower between the potentials of the connection points so and se, to LOW. Thus, each of the differential amplifiers 4*a* compare the reference voltage Vref, which is the middle potential applied from the outside, and the voltage of the corresponding odd-numbered source line S. If the pixels are normal, the potential of the odd-numbered source line S(odd) is slightly higher than the middle potential. Therefore, the connection point se of each of the differential amplifiers 4*a* has a lower potential than that of the connection point so. As a result, as shown in FIG. 16, the potential of the connection point se decreases. Here, the potential of the connection point so is left as it is.

Next, turning the SAp-ch driving power to HIGH operates P-channel transistors 21 and 22 of each of the differential amplifiers 4*a*. In other words, turning the SAp-ch driving power to HIGH changes the potential, which is slightly higher between the connection points so and se, to HIGH. If the pixels are normal, the potential of the odd-numbered source lines S(odd) is slightly higher than the middle potential. Thus, the connection points so of the differential amplifiers 4*a* have a higher potential than the connection points se. Therefore, as shown in FIG. 16, the potential of the connection points so increases.

If the pixels are poor, for example, if a leak in a capacitor Cs changes the data in each pixel to LOW, the potential of the odd-numbered source lines S(odd) is slightly decreased as indicated by the dashed line in FIG. 16. In this case, when the SAn-ch driving power is turned to LOW, the potential of the connection points se decreases as indicated by the dashed line in FIG. 16. Furthermore, when SAp-ch driving power is turned to HIGH, the potential of the connection points so increases as indicated by the dashed line in FIG. 16.

In this case, a fast operation is possible without any influence of the capacity, which is a load, of the source lines S since the test circuit connection signals TEo and TEe are off. Furthermore, since the reference voltage Vref does not have the potential written in the pixels, a failure in a pixel is detected as a failure in the pixel. In other words, since it can be identified as a failure in one pixel, the failure characteristic can be categorized in detail.

When the logic of the connection points se and connection points so of the differential amplifiers 4*a* are fixed to either one of HIGH and LOW, the test circuit connection signal TEo is turned to HIGH, and the fixed logic data is rewritten in the odd-numbered source lines S(odd). Since the potential of each pixel connecting to the gate line G1 is read out to each corresponding odd-numbered source line S(odd), the odd-numbered gates TG1, TG3, TG5 to last TGn (or TGn−1) of the transistors of the transmission gate portion 6 are opened (that is, turned to HIGH). Then, the pixel data of the pixels at the first row is read out in order from the image signal line 7 and is output to the output terminals outo and oute.

After the data of all pixels connecting to the gate line G1 is read out, the gate line G1 is turned to LOW, and the SAn-ch driving power and SAp-ch driving power are changed to have the middle potential to stop the operation of the differential amplifiers 4*a*. Then, the pre-charge gate voltage PCG is turned to HIGH, and all of the source lines S are pre-charged.

Subsequently, the operation is repeated on all of the gate lines G2 to Gm so that the gate lines can be examined sequentially.

Subsequent to the end of the examination operation performed by writing HIGH data to all pixels as described above, LOW data is written in all pixels in the odd-numbered columns and the same examination is performed thereon, whereby all examinations are completed.

Further subsequently, pixels in an even-numbered column are to be examined. In other words, with the test circuit connection signal TEo fixed to LOW and with the test circuit connection signal TEe varied, the same examination as the examination performed on pixels in an odd-numbered column is performed in a case where HIGH data is written in pixels in an even-numbered column and a case where LOW data is written therein.

Figure 17:
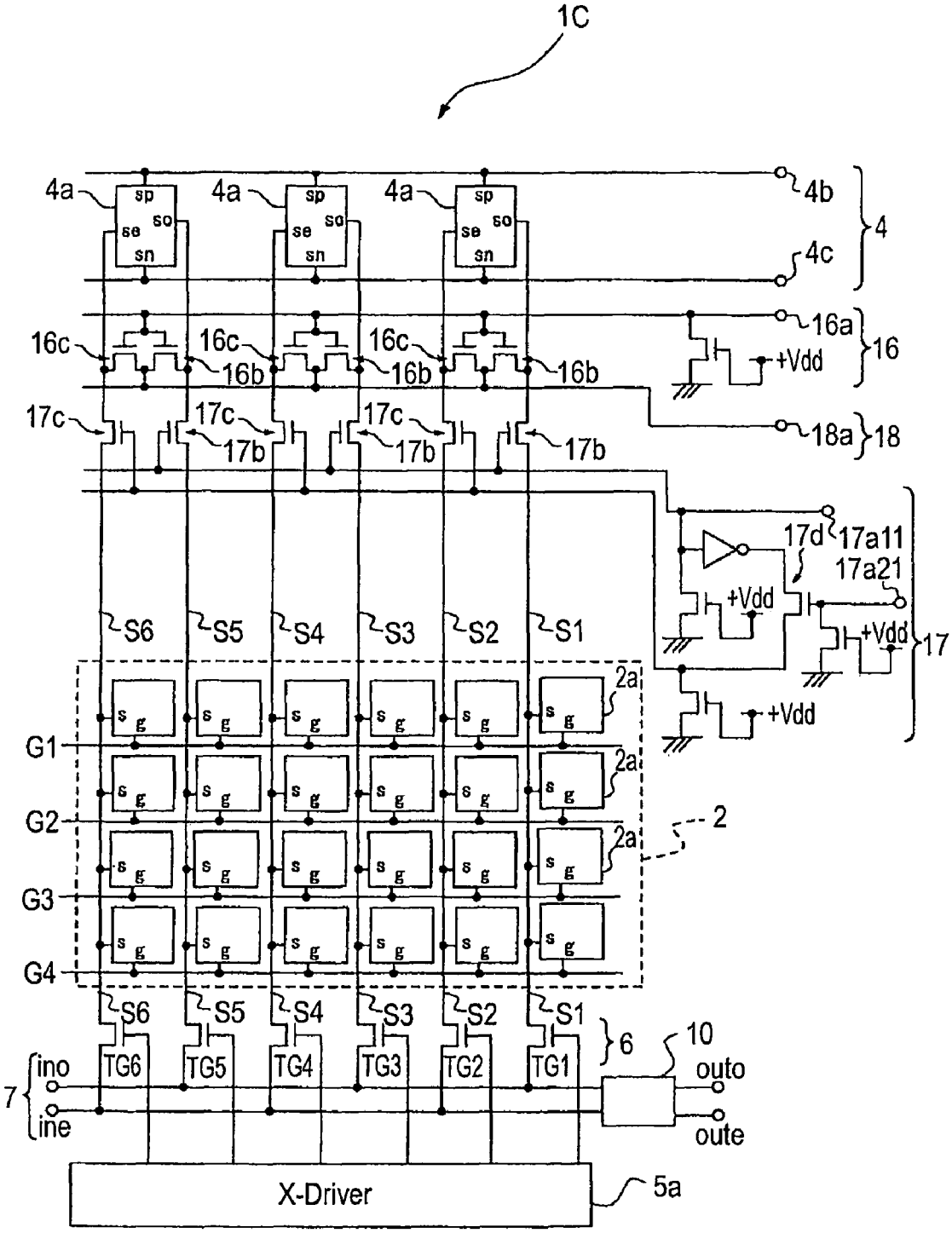
FIG. 17 is a circuit diagram showing an improved form of the connection gate in FIG. 15.

Though one differential amplifier 4*a* is required for one source line according to the second embodiment, one differential amplifier 4*a* is only required for two source lines according to the third embodiment, which can decrease the number of differential amplifiers 4*a* on the substrate and therefor can increase the size of each of the transistors within the differential amplifiers 4*a*. Since the reduction of asymmetry of the transistors within the differential amplifiers 4*a*, the improvement of driving power, the reduction of performance variation and so on can be achieved as a result, the differential amplifiers 4*a* can have stability and high sensitivity. FIG. 17 is a circuit diagram showing an improved form of the connection gate portion 17 in FIG. 15. In the connection gate portion 17, one connection point so of each of the differential amplifiers 4*a* is, as shown in FIG. 15, connected to the odd-numbered source line S(odd) through one transistor 17*b* of the connection gate portion 17. The other connection point se of each of the differential amplifiers 4*a* is connected to the even-numbered source line S(even) through the other transistor 17*c* of the connection gate portion 17. In FIG. 17, the gates of the transistors 17*b* are connected to a gate select terminal 17*a*11 for test circuit connection and, at the same time, to the gates of the transistors 17*c* through a transistor 17*d* having the gate connecting to an inverter and a gate-enable terminal 17*a*21. A test circuit connection gate select signal TGS (Test Gate Select) is supplied to the gate select terminal 17*a*11, and a test circuit connection signal TE (Test Enable) is supplied to a gate enable terminal 17*a*21.

Hence, turning the gate enable terminal 17*a*21 to HIGH turns on either one of the transistors 17*b* and 17*c* so that the data of either one of pixels in the odd-numbered source line S(odd) and in the even-numbered source line S(even) can be only read out by one differential amplifier 4*a*.

The transistors 17*b* and 17*c* are turned ON and OFF, respectively, when the test circuit connection gate select signal. TGS is HIGH so that the data of pixels in the odd-numbered source line S(odd) can be read out. On the other hand, the transistors 17*c* and 17*b* are turned ON and OFF, respectively, when the test circuit connection gate select signal. TGS is LOW so that the data of pixels in the even-numbered source line S(even) can be read out. When no voltage signal is applied to the gate select terminal 17*a*11 and gate enable terminal 17*a*21, that is, in the floating state, the transistors 17*b* and 17*c* are both OFF whereby the test circuit is isolated.

Providing an inverter between the gates of the transistors 17*b* and 17*c* can prevent the odd-numbered source line S(odd) and even-numbered source line S(even) from simultaneously connecting to the differential amplifier 4*a*, which can further prevent a misoperation in advance.

As described above, while a failure in one pixel is detected as a failure in two pixels according to the first embodiment, a failure in one pixel is detected as a failure in one pixel according to the second and third embodiments. Therefore, the failure characteristic can be categorized in more detail under the circuit construction according to the second and third embodiments than that under the circuit construction according to the first embodiment.

According to the second and third embodiments, a fast operation is possible without any influence of the capacity which is a load, of the source lines S, which decreases the load during the operation of the differential amplifiers by using the test circuit connection signals TEo and TEe.

Furthermore, according to the second and third embodiments, the reference voltage can be externally controlled since the reference voltage is externally applied. Thus, an examination for a detail evaluation is possible such as a search of a holding potential.

Having described in the three embodiments, an active matrix type display device substrate as an example of an electrooptic device substrate of the present invention, the present invention is not limited to the embodiments but various changes, modifications and so on can be made thereto without departing from the scope or spirit of the construction of the present invention.

For example, the present invention is also applicable to a display device substrate having an input function with an optical sensor in a pixel. In this case, the differential amplifier 4*a* may be employed as an amplifier for an output signal from the output signal.

The present invention is further applicable to a display device substrate with a memory element (such as an SRAM and an FERAM) in a pixel. In this case, the memory element can be examined by the reading circuit portion 4.

The object of the present invention is to improve the precision for reading out the potential (examination signal) supplied to a pixel. The present invention is also used for the applications excluding pixel examination from the viewpoint of the improvement of the precision for reading out a signal.

For example, in the application to the driving for image display, the present invention can be applied to pre-charging and/or insertion of black display.

For example, the circuit according to the second embodiment of the invention may be applied thereto.

In a driving method for inverting the polarity of the potential of an image signal with respect to that of the center potential, an image signal to be supplied to each pixel is input to se of the differential amplifier 4*a* as a signal corresponding to the examination signal (that is, HIGH signal and LOW signal) according to the second embodiment and the center potential with the inverted polarity of that of the image signal is input to so as a signal corresponding to the reference voltage Vref.

Then, in the differential amplifier 4*a*, the potential of the image signal supplied to the pixel, which is input to se, and the center potential with the inverted polarity, which is input to so, are compared, and the potential difference between them is amplified. In other words, when the potential of the image signal is higher (positive polarity) than the center potential, the potential of se is output as the highest potential (HIGH signal). When the potential of the image signal is lower (negative polarity) than the center potential, the potential of se is output as the lowest potential (LOW signal) (and the output of so has the reverse relationship).

Here, in a normally white mode, the center potential corresponds to white display, and the highest potential and lowest potential correspond to black display. Thus, the potential corresponding to the image signal with the lowest intensity (black display) can be always obtained as the outputs of the se and so.

In this case, the output potential of the se and the output potential of the so have inverted polarities with respect to the center potential.

Here, the insertion of a black signal (impulse driving) can be implemented by supplying the output potential of the se or so to each pixel in an effective display period.

When the polarity of the potential of an image signal is inverted in each one horizontal scan period, that is, when so-called 1H inversion driving is performed, the output potential of the so is supplied to each source line in the horizontal retrace time so that the source line can be pre-charged with the potential corresponding to black display during the 1H inversion.

The present invention further includes an electrooptic device having an electrooptic device substrate of the present invention.

For example, the present invention may include an electrooptic device having a pair of substrates with an electrooptic substance therebetween, one of the substrates being an electrooptic device substrate of the present invention.

Figure 18:
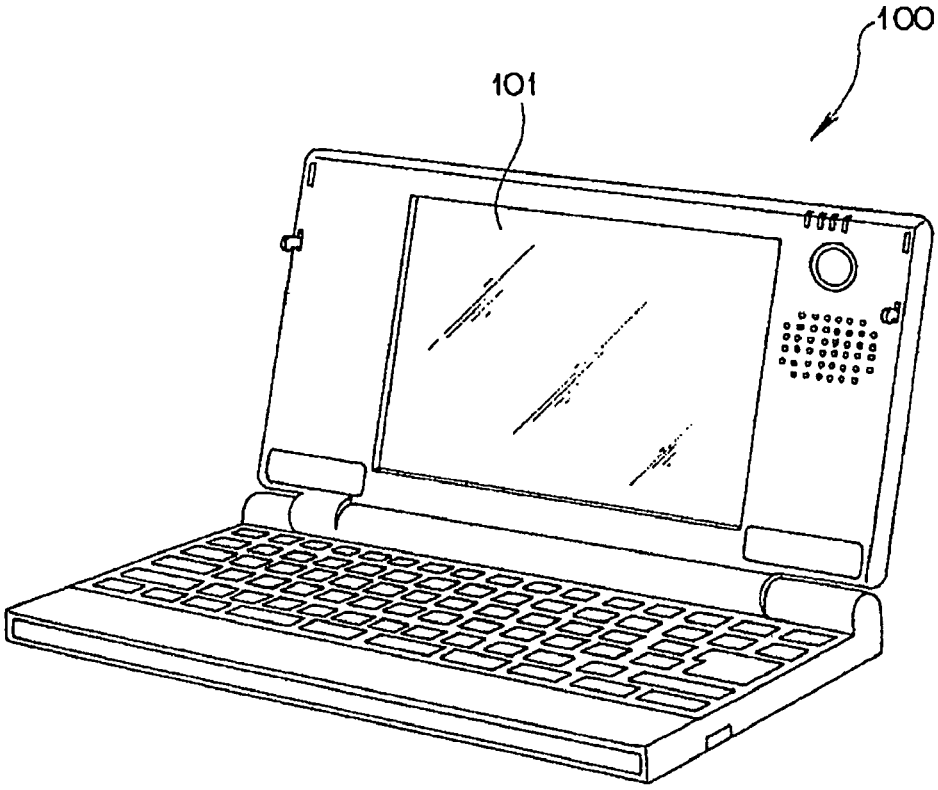
FIG. 18 is an appearance diagram of a personal computer, which is an electrooptic apparatus example to which the invention is applied.
Figure 19:
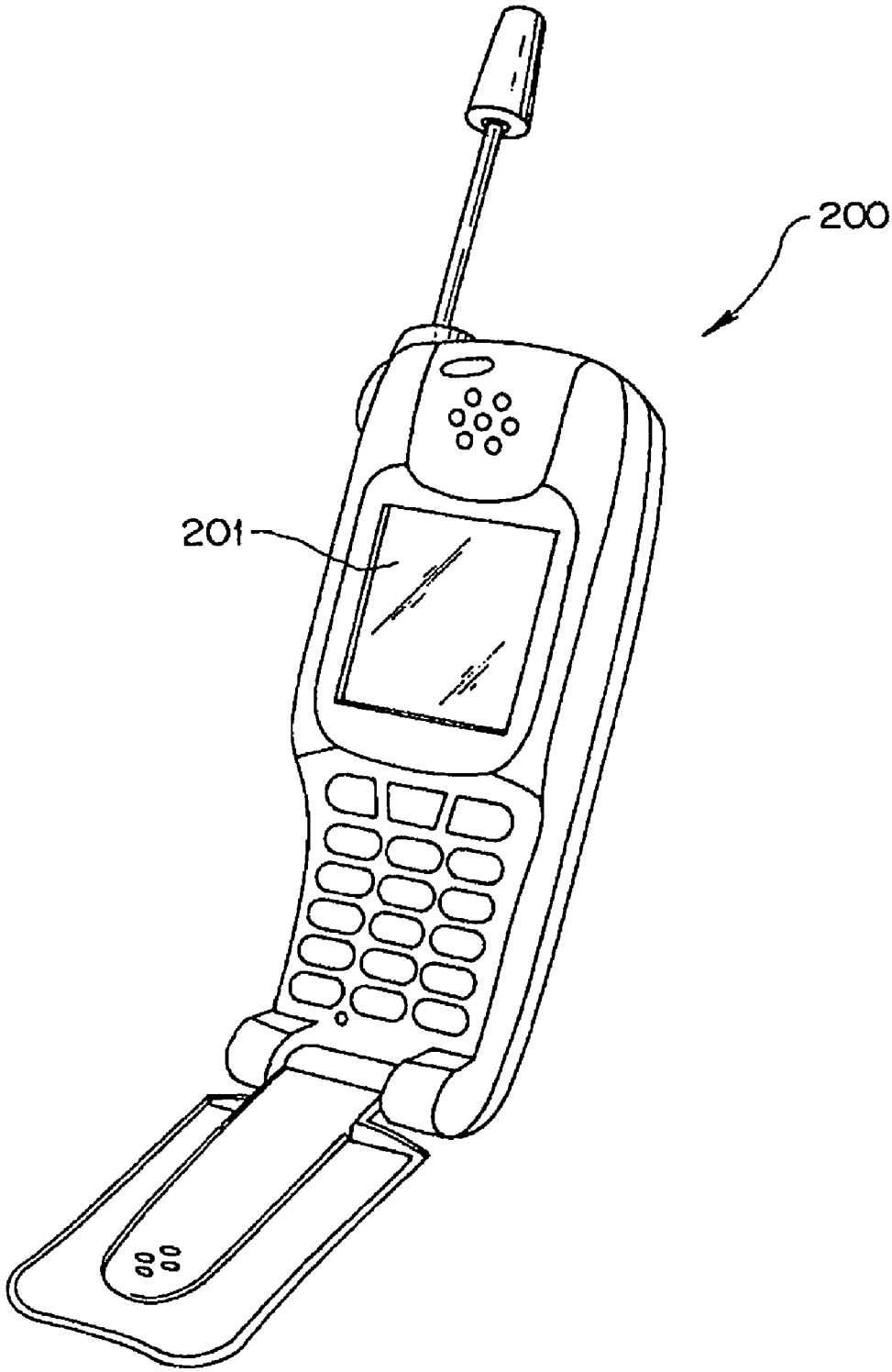
FIG. 19 is an appearance diagram of a cellular telephone, which is another electrooptic apparatus example to which the invention is applied.
Figure 20:
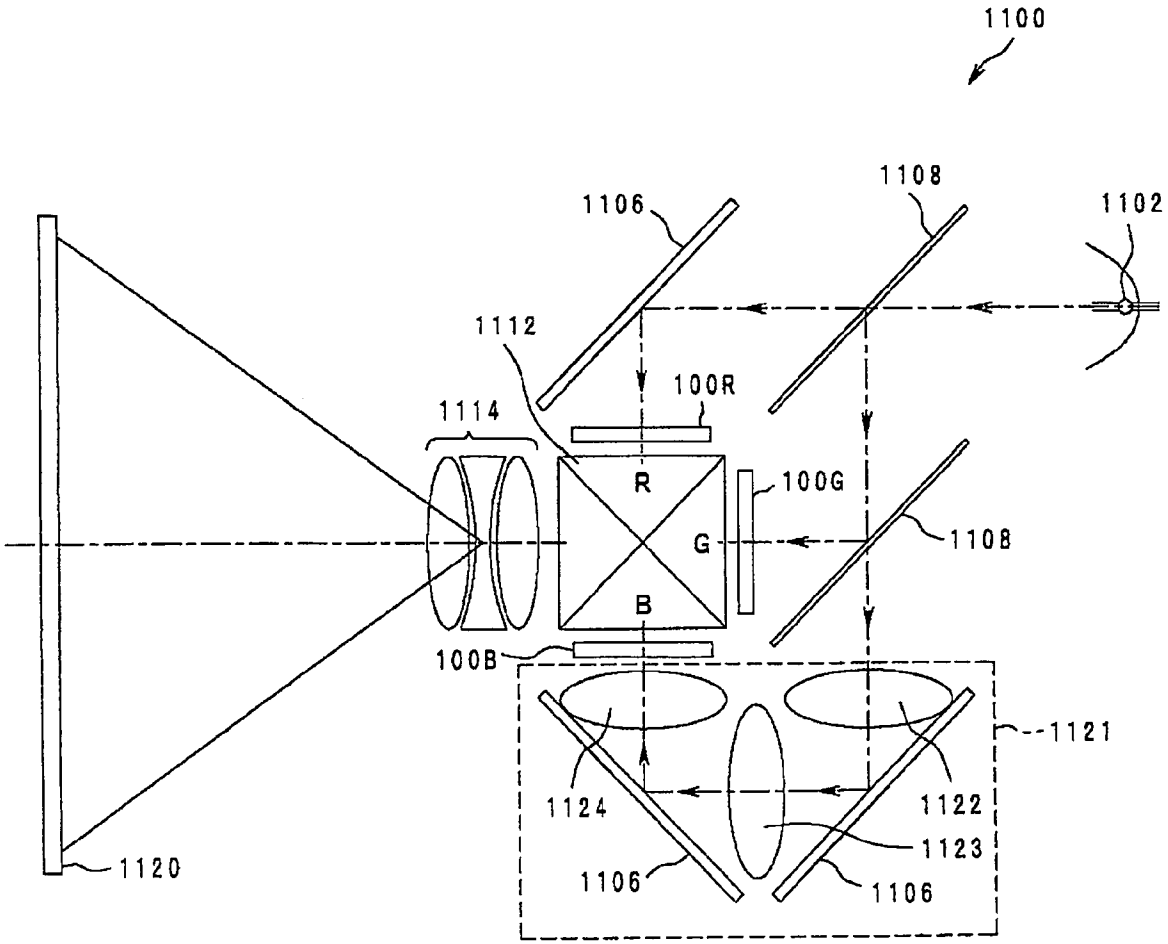
FIG. 20 is an appearance diagram of a personal computer, which is another electrooptic apparatus example to which the invention is applied.

The present invention further includes an electronic apparatus having the electrooptic device. FIGS. 18 to 20 are diagrams showing examples of the electronic apparatus. FIG. 18 is an appearance diagram of a personal computer according to one examples FIG. 19 is an appearance diagram of a cellular phone according to one example.

As shown in FIG. 18, the electrooptic device such as a liquid crystal display device is used as a display portion 101 of a personal computer 100, which is the electronic apparatus. As shown in FIG. 19, the electrooptic device such as a liquid crystal display device is used as a display portion 201 of a cellular phone 200, which is the electronic apparatus.

FIG. 20 is an explanatory diagram of a projection-type color display device, which is an example of the electronic apparatus having the electrooptic device as a light bulb.

In FIG. 20, a liquid crystal projector 1100, which is an example of the projection-type color display device according to this embodiment has three liquid crystal modules including a liquid crystal device including a drive circuit mounted on a TFT array substrate and is a projector having the liquid crystal modules as light bulbs 100R, 100G and 100B for RGB. In the liquid crystal projector 1100, the projection light emitted from a lamp unit 1102 of a white light source such as a metal halide lamp is divided into light components R, G and B corresponding to the three primary colors of RGB and guided to the light bulbs 100R, 100G and 100B corresponding to the colors by three mirrors 1106 and two dichromic mirrors 1108. In this case, in order to prevent a light loss due to a long optical path, the B-light is particularly guided through a relay lens system 121 including an input lens 1122, a relay lens 1123 and an output lens 1124. Then, the light components corresponding to the three primary colors, which are modulated by the light bulbs 100R, 100G and 100B, are re-synthesized by a dichromic prism 1112 and are then projected to a screen 1120 as a color image through a projection lens 1114.

The electronic apparatus may further include a television, view-finder type/monitor direct-view type video tape recorder, a car navigation apparatus, a pager, an electronic notepad, a calculator, a word processor, a work station, a television phone, a POS terminal, a digital still camera and an apparatus including a touch panel. Apparently, a display panel according to the present invention is applicable to these kinds of electronic apparatus.

The invention claimed is:

1. An electrooptic apparatus substrate comprising:

a plurality of scan lines and a plurality of signal lines intersecting each other;

a plurality of pixels disposed in accordance with the intersections of the plurality of scan lines and the plurality of signal lines; and amplifying circuits electrically connected to the signal lines, to which a signal input to the pixels is input through the signal lines, for amplifying the potential of the input signal, wherein each amplifying circuit is electrically connected to a pair of the signal lines and amplifies a potential difference between the signals supplied from each of the pair of signal lines.

2. An electrooptic apparatus substrate comprising:

a plurality of scan lines and a plurality of signal lines intersecting each other;

a plurality of pixels disposed in a matrix in accordance with the intersections of the plurality of scan lines and the plurality of signal lines;

a plurality of switching elements each provided for each of the multiple plurality of pixels;

amplifying circuits to which a first potential signal is input through a first signal line of the plurality of signal lines and a second potential signal is input as a reference potential; and a data reader that reads an output potential signal output from the amplifying circuits to the plurality of signal lines, wherein each amplifying circuit compares the first potential signal and the second potential signal, and, if the first potential signal is lower than the second potential signal, lowers a potential of the first signal line and outputs a lowered output potential signal to the first signal line, and, if the first potential signal is higher than the second potential signal, heightens the potential of the first signal line and outputs a heightened output potential signal to the first signal line.

3. The electrooptic apparatus substrate according to claim 2, further comprising:

an image signal line for supplying an image signal supplied to the plurality of pixels and a plurality of transmission gates for supplying an image signal supplied from the image signal line to the plurality of signal lines, wherein the data reader includes the image signal line.

4. The electrooptic apparatus substrate according to claim 2, wherein:

the first potential signal has a potential of a signal supplied to all or a part of the plurality of pixels through the plurality of switching elements; and a potential of the second potential signal is a potential supplied from a reference signal line.

5. The electrooptic apparatus substrate according to claim 2, wherein:

the first potential signal and the second potential signal each have a potential of a signal supplied to all or a part of the plurality of pixels through the plurality of switching elements; and the first potential signal and the second potential signal are supplied to respective amplifying circuits through the first signal line and the second signal line of the plurality of signal lines, respectively.

6. The electrooptic apparatus substrate according to claim 2, wherein each amplifying circuit is a differential amplifier.

7. The electrooptic apparatus substrate according to claim 2, wherein the data reader has a differential amplifier for outputting the read potential signal.

8. The electrooptic apparatus substrate according to claim 2, wherein each of the plurality of pixels has an additional capacitor.

9. The electrooptic apparatus substrate according to claim 2, further comprising a pre-charge circuit connected to the plurality of signal lines for pre-charging the potential of the plurality of signal lines to a predetermined potential.

10. An electrooptic apparatus in which an electrooptic substance is provided between a pair of substrates, the apparatus comprising the electrooptic apparatus substrate according to claim 2 on one of the paired substrates.

11. An electronic equipment comprising the electrooptic apparatus according to claim 10.

12. An examination method for an electrooptic apparatus substrate having a plurality of scan lines and a plurality of signal lines intersecting each other, a plurality of pixels disposed in a matrix for the intersections of the plurality of scan lines and the plurality of signal lines, and a plurality of switching elements each provided for each of the plurality of pixels, the method comprising:

a supplying step of supplying a first potential signal to a pixel corresponding to one of the signal lines;

a reading step of reading the first potential signal supplied to the pixel through the corresponding signal line;

an output step of comparing a second potential signal having a different potential from that of the first potential signal and serving as a reference signal and the read first potential signal, and, if the first potential signal is lower than the second potential signal, lowering a potential of the corresponding signal line and outputting a lowered output potential signal to the corresponding signal line, and, if the first potential signal is higher than the second potential signal, heightening the potential of the corresponding signal line and outputting a heightened output potential signal to the corresponding signal line; and a comparing step of comparing the first potential signal supplied by the supplying step and one of the output potential signals output by the output step.

13. The examination method for an electrooptic apparatus substrate according to claim 12, further comprising a pre-charging step of causing the corresponding signal line to have a predetermined pre-charge potential before the reading step.

14. The examination method for an electrooptic apparatus substrate according to claim 13, wherein the predetermined pre-charge potential is a middle potential between the first potential signal and the second potential signal.

15. The examination method for an electrooptic apparatus substrate according to claim 14, wherein:

in the supplying step, one of the two pixels is handled as a pixel to be examined and a LOW or HIGH signal is supplied as the first potential to the pixel to be examined and the other of the two pixels is handled as a reference pixel and a middle potential signal having the potential between the potential of the first LOW signal and the potential of the HIGH signal is supplied as the second potential to the reference pixel; and a failure in the switching element or additional capacitor is determined if the potential read from the pixel to be examined does not agree with the first potential in the comparing step.

16. The examination method for an electrooptic apparatus substrate according to claim 13, wherein the predetermined pre-charge potential is a potential higher than the potential heightened by the output step.

17. The examination method for an electrooptic apparatus substrate according to claim 16, wherein:

in the supplying step, one of the two pixels is handled as a pixel to be examined and a LOW signal is supplied as the first potential to the pixel to be examined and the other of the two pixels is handled as a reference pixel and a HIGH signal is supplied as the second potential to the reference pixel; and a failure in the switching element is determined if the potential signal read from the pixel to be examined is HIGH in the comparing step.

18. The examination method for an electrooptic apparatus substrate according to claim 12, wherein:

in the supplying step, the first and second potential signals have potentials of the signals supplied to two pixels through the plurality of switching elements; and in the reading step, the first and second potential signals are read through two corresponding signal lines.

19. The examination method for an electrooptic apparatus substrate according to claim 18, wherein:

in the supplying step, one of the two pixels is handled as a pixel to be examined and a HIGH signal is supplied as the first potential signal to the pixel to be examined and the other of the two pixels is handled as a reference pixel and a LOW signal is supplied as the second potential signal to the reference pixel; and a failure in the additional capacitor is determined if the potential signal read from the pixel to be examined is LOW in the comparing step.

20. The examination method for an electrooptic apparatus substrate according to claim 19, wherein a potential of a common fixed electrode of the additional capacitor is a potential lower than the potential in supplying the LOW signal.

21. The examination method for an electrooptic apparatus substrate according to claim 18 wherein the two corresponding signal lines are adjacent to each other.

22. The examination method for an electrooptic apparatus substrate according to claim 12, wherein each of the plurality of pixels has an additional capacitor.

23. The examination method for an electrooptic apparatus substrate according to claim 12, wherein the potential of the second potential signal is an externally supplied potential.

24. The examination method for an electrooptic apparatus substrate according to claim 12, wherein the supplying step, the reading step, the output step and the comparing step are sequentially performed on the plurality of pixels.

* * * * *